US005677042A

United States Patent [19]

Massa et al.

[11] Patent Number: 5,677,042

[45] Date of Patent: Oct. 14, 1997

[54] COMPOSITE CERMET ARTICLES AND METHOD OF MAKING

[75] Inventors: Ted R. Massa, Latrobe; John S. Van Kirk, Murrysville; Edward V. Conley, North Huntingdon, all of Pa.

[73] Assignee: Kennametal Inc., Latrobe, Pa.

[21] Appl. No.: 469,169

[22] Filed: Jun. 6, 1995

Related U.S. Application Data

[63] Continuation of Ser. No. 363,172, Dec. 23, 1994.

[51] Int. Cl.[6] ..... B22F 3/12

[52] U.S. Cl. ..... 428/212; 175/379; 175/431; 175/425; 175/426; 428/328; 428/472; 428/697; 428/698

[58] Field of Search ..... 428/697, 698, 428/699, 323, 328, 212, 472; 175/379, 425, 426, 431

[56] References Cited

U.S. PATENT DOCUMENTS

| | | | |
|---|---|---|---|
| 2,888,247 | 5/1959 | Haglund | 255/63 |
| 3,850,368 | 11/1974 | Boeckeler | 233/25 |
| 3,888,662 | 6/1975 | Boeckeler | 75/203 |
| 3,909,895 | 10/1975 | Abrahamson et al. | 29/95 |
| 4,194,790 | 3/1980 | Kenny et al. | 299/79 |

(List continued on next page.)

FOREIGN PATENT DOCUMENTS

| | | |
|---|---|---|
| 1119850 | 3/1982 | Canada . |
| 0111600 | 6/1984 | European Pat. Off. . |
| 0194018 | 10/1986 | European Pat. Off. . |
| 0233162 | 8/1987 | European Pat. Off. . |
| 0542704 | 5/1993 | European Pat. Off. . |
| 2343885 | of 1977 | France . |
| 3005684 | 8/1981 | Germany . |
| 3519101 | 5/1985 | Germany . |
| 8813731 | 5/1989 | Germany . |
| 659765 | 10/1951 | United Kingdom . |
| 806406 | 12/1958 | United Kingdom . |
| 911461 | 11/1962 | United Kingdom . |
| 1115908 | 6/1968 | United Kingdom . |
| 2004315 | 3/1979 | United Kingdom . |
| 2017153 | 10/1979 | United Kingdom . |
| 2037223 | 7/1980 | United Kingdom . |
| 2211875 | 7/1989 | United Kingdom . |

OTHER PUBLICATIONS

Viswanadham, R. K., "Stability of Microstructural Discontinuities in Cemented Carbides," International Journal of Powder Metallurgy, Oct., 1987, USA, vol. 23, No. 4, ISSN 0361–3488, pp. 229–235.

(List continued on next page.)

*Primary Examiner*—Archene Turner
*Attorney, Agent, or Firm*—Stanislav Antolin

[57] ABSTRACT

Methods for making, methods for using and articles comprising cermets, preferably cemented carbides and more preferably tungsten carbide, having at least two regions exhibiting at least one property that differs are discussed. Preferably, the cermets further exhibit uniform or controlled wear to impart a self-sharpening character to an article. The multiple-region cermets are particularly useful in wear applications. The cermets are manufactured by juxtaposing and densifying at least two powder blends having different properties (e.g., differential carbide grain size or differential carbide chemistry or differential binder content or differential binder chemistry or any combination of the preceding). Preferably, a first region of the cermet comprises a first ceramic component having a relatively coarse grain size and a prescribed binder content and a second region, juxtaposing or adjoining the first region, comprises a second ceramic component, preferably carbide(s), having a grain size less than the grain size of the first region, a second binder content greater than the binder content of the first region or both. These articles have an extended useful life relative to the useful life of monolithic cermets in such applications as, for example, wear. The multiple region cermets of the present invention may be used with articles comprising tools for materials manipulation or removal including, for example, mining, construction, agricultural, and metal removal applications.

42 Claims, 11 Drawing Sheets

U.S. PATENT DOCUMENTS

| | | | |
|---|---|---|---|
| 4,249,955 | 2/1981 | Grab et al. | 106/308 |
| 4,359,335 | 11/1982 | Garner | 75/208 |
| 4,484,644 | 11/1984 | Cook et al. | 175/410 |
| 4,491,559 | 1/1985 | Grab et al. | 419/36 |
| 4,610,931 | 9/1986 | Nemeth et al. | 428/547 |
| 4,705,124 | 11/1987 | Abrahamson et al. | 175/410 |
| 4,722,405 | 2/1988 | Langford, Jr. | 175/374 |
| 4,743,515 | 5/1988 | Fischer et al. | 428/698 |
| 4,820,482 | 4/1989 | Fischer et al. | 419/15 |
| 4,854,405 | 8/1989 | Stroud | 175/374 |
| 4,956,012 | 9/1990 | Jacobs et al. | 75/236 |
| 5,074,623 | 12/1991 | Hedlund et al. | 299/79 |
| 5,250,367 | 10/1993 | Santhanam et al. | 428/698 |
| 5,333,520 | 8/1994 | Fischer et al. | 76/108.2 |
| 5,335,738 | 8/1994 | Waldenstrom et al. | 175/420.2 |
| 5,467,669 | 11/1995 | Stroud | 76/108 |
| 5,484,191 | 1/1996 | Sollami | 299/105 |
| 5,543,235 | 8/1996 | Mirchandani et al. | 428/547 |
| 5,593,474 | 1/1997 | Keshavan et al. | 75/240 |

OTHER PUBLICATIONS

Richter, V., "Fabrication and Properties of Gradient Hard Metals," 3rd International Symposium on Structural and Functional Gradient Materials, Proceedings of FGM '94, Lausanne, Switzerland, 10–12 Oct. 1994, 1995, Lausanne, Switzerland, Presses Polytech. Univ., Romandes, Switzerland, whole document.

"Cemented Carbide in High Pressure Equipment", B. Zetterlund, *High Pressure Engineering*, vol. 2 (1977), pp. 35–40.

"Utilization of Magnetic Saturation Measurements for Carbon Control in Cemented Carbides", D. R. Moyle & E. R. Kimmel, *1984 ASM/SCTE Conference on Technology Advancements in Cemented Carbide Production*, Pittsburgh, PA 2–4 Dec. 1984, also available as *Metals/Materials Technology Series No. 8415–009*(1984), pp. 1–5, American Society for Metals, Metals Park, Ohio.

"Binder Mean–Free–Path Determination in Cemented Carbide by Coercive Force and Material Composition", R. Porat & U. Malek, *Materials Science and Engineering, vol. A105/106 (1988), pp. 289–292.*

"Standard Practice for Evaluating Apparent Grain Size and Distribution of Cemented Tungsten Carbides", ASTM Designation B–390–92, *1992 Annual Book of ASTM Standards*, vol. 02.05, pp. 156–159.

"Isotropic and Gradient Hard Metals Fabricated by Infiltration", M. Gasik, V. Jaervelae, K. Lilius & S. Stroemberg, *Proceeding of the 13th International Plansee Seminar*, Eds. H. Bildstein & M. Ede, *Metallwerk Plansee*, vol. 2 (1993), pp. 553–561.

"Processing of Functional–Gradient WC–Co Cerments by Powder Metallurgy", C. Colin, L. Durant, N. Favrot, J. Besson, G. Barbier, & F. Delannay, *International Journal of Refractory Metals & Hard Materials*, vol. 12, No. 3, (1993–1994), pp. 145–152.

COMPOSITE CERMET ARTICLES AND METHOD OF MAKING

This is a continuation of application Ser. No 08/363,172 filed on Dec. 23, 1994 now allowed.

BACKGROUND

Cermet is a term used to describe a monolithic material composed of a ceramic component and a binder component. The ceramic component comprises a nonmetallic compound or a metalloid. The ceramic component may or may not be interconnected in two or three dimensions. The binder component comprises a metal or alloy and is generally interconnected in three dimensions. The binder component cements the ceramic component together to form the monolithic material. Each monolithic cermet's properties are derived from the interplay of the characteristics of the ceramic component and the characteristics of the binder component.

A cermet family may be defined as a monolithic cermet consisting of specified ceramic component combined with a specified binder component. Tungsten carbide cemented together by a cobalt alloy is an example of a family (WC-Co family, a cemented carbide). The properties of a cermet family may be tailored, for example, by adjusting an amount, a characteristic feature, or an amount and a characteristic feature of each component separately or together. However, an improvement of one material property invariably decreases another. When, for example, in the WC-Co family resistance to wear is improved, the resistance to breakage decreases. Thus, in the design of monolithic cemented carbides there is a never ending cycle that includes the improvement of one material property at the expense of another.

Despite this, monolithic cemented carbides are used in equipment subject to aggressive wear, impact, or both. However, rather than build the entire equipment from monolithic cemented carbides, only selected portions of the equipment comprise the monolithic cemented carbide. These portions experience the aggressive wear, impact, or both. In some equipment the cemented carbide portion has a specified profile that should be sustained to maintain the maximum efficiency of the equipment. As the specified profile changes, the equipment's efficiency decreases. If the equipment is used for cutting a work piece, the fraction of the usable removed sections of the work piece decreases as the profile of the cemented carbide deviates from the specified profile.

For example, as the specified profiles of cemented carbide cutting tips used in conjunction with a continuous coal mining machine change, once sharp cemented carbide cutting tips transform into cemented carbide blunt tips pounding on a coal seam to create dust, fine coal, and noise rather than desirable coarse coal. During this transformation, power supplied by a motor driving the continuous mining machine must also be increased. One solution to the loss of a specified profile includes removing the equipment from use and reprofiling the cemented carbide—this is costly due to the loss of productive use of the equipment during reprofiling. Another solution involves scrapping the used cemented carbide portion and inserting a new cemented carbide—this too is costly due to the loss of productive use of the equipment during refitting and the scrapped cemented carbide. If these cemented carbides could be made to sustain their specified profiles, for example, by self sharpening, economic and technical gains would result.

A solution to the endless cycle of adjusting one property of a monolithic cermet at the expense of another is to combine several monolithic cermets to form a multiple region cermet article. The resources (i.e., both time and money) of many individuals and companies throughout the world have been directed to the development of multiple region cemented carbide articles. The amount of resources directed to the development effort is demonstrated by the number of publications, US and foreign patents, and foreign patent publications on the subject. Some of the many US and foreign patents, and foreign patent publications include: U.S. Pat. Nos. 2,888,247; 3,909,895; 4,194,790; 4,359,355; 4,427,098; 4,722,405; 4,743,515; 4,820,482; 4,854,405; 5,074,623; 5,333,520; and 5,335,738; and foreign patent publication nos. DE-A-3 519 101; GB-A 806 406; EPA-0 111 600; DE-A-3 005 684; DE-A-3 519 738; FR-A-2 343 885; GB-A-1 115 908; GB-A-2 017 153; and EP-A-0 542 704. Despite the amount of resources dedicated, no satisfactory multiple region cemented carbide article is commercially available nor for that matter, currently exists. Further, there is no satisfactory methods for making multiple region cemented carbide articles. Furthermore, there are no satisfactory monolithic self-sharpening cemented carbide articles let alone multiple region cemented carbide articles. Moreover, there are no satisfactory methods for making multiple region cemented carbide articles that are further self-sharpening.

Some of the resources (i.e., both time and money) have been expended for "thought experiments" and merely present wishes—in that they fail to teach the methods making such multiple region cemented carbide articles.

Other resources have been spent developing complicated methods. Some methods included the pre-engineering starting ingredients, green body geometry or both. For example, the starting ingredients used to make a multiple region cemented carbide article are independently formed as distinct green bodies. Sometimes, the independently formed green bodies are also independently sintered and, sometimes after grinding, assembled, for example, by soldering, brazing or shrink fitting to form a multiple region cemented carbide article. Other times, independently formed green bodies are assembled and then sintered. The different combinations of the same ingredients that comprise the independently formed green bodies respond to sintering differently. Each combination of ingredients shrinks uniquely. Each combination of ingredients responds uniquely to a sintering temperature, time, atmosphere, or any combination of the preceding. Only the complex pre-engineering of forming dies and, thus, greenbody dimensions allows assembly followed by sintering. To allow the pre-engineering, an extensive data base containing the ingredients response to different temperatures, times, atmospheres, or any combination of the preceding is required. The building and maintaining of such a data base are cost prohibitive. To avoid those costs, elaborate process control equipment might be used. This too is expensive. Further, when using elaborate process control equipment, minor deviations from prescribed processing parameters rather than yielding useful multiple region cemented carbide articles—yield scrap.

Still other resources have been expended on laborious methods for forming multiple region cemented carbide articles. For example, substoichiometric monolithic cemented carbide articles are initially sintered. Their compositions are deficient with respect to carbon and thus the cemented carbides contain eta-phase. The monolithic cemented carbide articles are then subjected to a carburizing environment that reacts to eliminate the eta-phase from a periphery of each article. These methods, in addition to the pre-engineering of the ingredients, require intermediate processing steps and carburizing equipment. Furthermore, the resultant multiple region cemented carbide articles offer only minimal benefits since once the carburized peripheral region wears away, their usefulness ceases.

For the foregoing reasons, there exists a need for multiple region cemented carbides that can be inexpensively manufactured. Further, there exists a need for multiple region cermet articles that can be inexpensively manufactured. Furthermore, there exists a need for multiple region cemented carbide articles that are further self-sharpening and can be inexpensively manufactured. Moreover, there exists a need for multiple region cermet articles that are further self-sharpening and can be inexpensively manufactured.

SUMMARY

The present invention relates to articles comprising cermets, preferably cemented carbides, having at least two regions exhibiting at least one different property. The present invention is further related to the methods of using these unique and novel articles. Also, the present invention relates to the methods of making these unique and novel articles.

The present invention satisfies a long-felt need in the cermet art for improved cermet material systems by providing articles having at least two regions having at least one property that differs and preferably further exhibiting uniform or controlled wear to impart self-sharpening characteristics on the article when used as a tool. Such multiple-region articles are particularly useful in wear applications. An example includes cermet articles having at least one leading edge or portion that exhibits wear resistance and an adjacent region that exhibits less wear resistance. A further advantage of the combination of the at least two regions includes a uniform or controlled wear of such articles and thus extending the cermets useful life since this unique characteristic imparts the retention of, for example, cutting ability of the article when used as a cutting element of a tool as the article is consumed during an operation.

The present invention provides a method for making the present articles by recognizing the solution to the problems encounter in making multiple-region articles. Historically, attempts at making multiple-region articles failed due to defects (e.g., green body cracking during sintering) arising during the articles' densification. Thus, the articles of the present invention are manufactured by methods that capitalized on the synergistic effects of processing parameters (e.g., differential carbide grain size or differential carbide chemistry or differential binder content or differential binder chemistry or any combination of the preceding) to achieve unique and novel multiple region articles. These articles have an extended useful life relative to the useful life of prior art articles in such applications as, for example, wear.

The unique and novel articles of the present invention comprise at least two regions, and may comprise multiple regions. A first region comprises a first ceramic component, preferably carbide(s), having a relatively coarse grain size and a prescribed binder content. A second region of the article, juxtaposing or adjoining the first region, comprises a second ceramic component, preferably carbide(s), having a grain size less than the grain size of the first region or a second binder content greater than the binder content of the first region or both. The first region of the present articles may be more wear resistant than the second region.

In an embodiment of the present invention, at least one property of each of the at least two regions is tailored by varying the ceramic component grain size or the ceramic component chemistry or the binder content or the binder chemistry or any combination of the preceding. The at least one property may include any of density, color, appearance, reactivity, electrical conductivity, strength, fracture toughness, elastic modulus, shear modulus, hardness, thermal conductivity, coefficient of thermal expansion, specific heat, magnetic susceptibility, coefficient of friction, wear resistance, impact resistance, chemical resistance, etc., or any combination of the preceding.

In an embodiment of the present invention, the amount of the at least two regions may be varied. For example, the thickness of the first region relative to the thickness of the second region may vary from the first region comprising a coating on the second region to the second region comprising a coating on the first region. Naturally, the first region and second region may exist in substantially equal proportions.

In an embodiment of the present invention, the juxtaposition of the first region and the second region may exist as a planar interface or a curved interface or a complex interface or any combination of the preceding. Furthermore, the first region may either totally envelop or be enveloped by the second region.

In an embodiment of this invention, the articles of the invention may be used for materials manipulation or removal including, for example, mining, construction, agricultural, and metal removal applications. Some examples of agricultural applications include seed boots (see e.g., U.S. Pat. No. 5,325,799), inserts for agricultural tools (see e.g., U.S. Pat. Nos. 5,314,029 and 5,310,009), disc blades (see e.g., U.S. Pat. No. 5,297,634), stump cutters or grinders (see e.g., U.S. Pat. Nos. 5,005,622; 4,998,574; and 4,214,617), furrowing tools (see e.g., U.S. Pat. Nos. 4,360,068 and 4,216,832), and earth working tools (see e.g., U.S. Pat. Nos. 4,859,543; 4,326,592; and 3,934,654). Some examples of mining and construction applications include cutting or digging tools (see e.g., U.S. Pat. Nos. 5,324,098; 5,261,499; 5,219,209; 5,141,289; 5,131,481; 5,112,411; 5,067,262; 4,981,328; and 4,316,636), earth augers (see e.g., U.S. Pat. Nos. 5,143,163 and 4,917,196), mineral or rock drills (see e.g., U.S. Pat. Nos. 5,184,689; 5,172,775; 4,716,976; 4,603,751; 4,550,791; 4,549,615; 4,324,368; and 3,763,941), construction equipment blades (see e.g., U.S. Pat. Nos. 4,770,253; 4,715,450; and 3,888,027), rolling cutters (see e.g., U.S. Pat. Nos. 3,804,425 and 3,734,213), earth working tools (see e.g., U.S. Pat. Nos. 4,859,543; 4,542,943; and 4,194,791), comminution machines (see e.g., U.S. Pat. Nos., 4,177,956 and 3,995,782), excavation tools (see e.g., U.S. Pat. Nos. 4,346,934; 4,069,880; and 3,558,671), and other mining or construction tools (see e.g., U.S. Pat. Nos. 5,226,489; 5,184,925; 5,131,724; 4,821,819; 4,817,743; 4,674,802; 4,371,210; 4,361,197; 4,335,794; 4,083,605; 4,005,906; and 3,797,592). Some examples of materials removal applications included materials cutting or milling inserts (see e.g., U.S. Pat. Nos. 4,946,319; 4,685,844; 4,610,931; 4,340,324; 4,318,643; 4,297,058; 4,259,033; and 2,201,979 (U.S. Pat. No. Re. 30,908)), materials cutting or milling inserts incorporating chip control features (see e.g., U.S. Pat. Nos. 5,141,367; 5,122,017; 5,166,167; 5,032,050; 4,993,893; 4,963,060; 4,957,396; 4,854,784; and 4,834,592), and materials cutting or milling inserts comprising coating applied by any of chemical vapor deposition (CVD), pressure vapor deposition (PVD), conversion coating, etc. (see e.g., U.S. Pat. Nos. 5,325,747; 5,266,388; 5,250,367; 5,232,318; 5,188,489; 5,075,181; 4,984,940; and 4,610,931 (U.S. Pat. No. Re. 34,180). The subject matter of all of the above patents relating to applications is incorporated by reference in the present application. Particularly, the articles may be used in wear applications where an article comprising, for example, a pre-selected geometry with a leading edge manipulates or removes materials (e.g., rock, wood, ore, coal, earth, road surfaces, synthetic materials, metals, alloys, composite materials (ceramic matrix composites (CMCs)), metal matrix composites (MMCs), and polymer or plastic matrix composites (PMCs), polymers, etc.). More particularly, the articles may be used in applications where it is desirable to substantially maintain a pre-selected geometry during the wear life of the article.

An embodiment of the present invention relates to the novel method of making the present novel and unique articles. That is, at least a first powder blend and a second powder blend are arranged in a prescribed manner to form a green body. If the shape of the green body does not correspond substantially to the shape of the final article, then the green body may be formed into a desired shape, for example, by green machining or plastically deforming or sculpting the green body or by any other means. The green body, whether or not shaped, may then be densified to form a cermet, preferably a cemented carbide article. If the densified article has not been pre-shaped or when additional shaping is desired, the densified article may be subjected to a grinding or other machining operations.

In an embodiment of the present invention, the constituents of a first powder blend and a second powder blend may be selected such that the resultant article exhibits the characteristic discussed above. For example, the average particle size of the ceramic component, preferably carbide(s), of the first powder blend is relatively larger than the average particle size of the ceramic component, preferably carbide (s), of the second powder blend. Additionally, the binder content of a first powder blend and a second powder blend may be substantially the same or substantially different. Furthermore, the binder chemistry or the ceramic component chemistry, preferably carbide(s) chemistry, or both may be substantially the same, substantially different or vary continuously between the at least two powder blends.

DETAILED DESCRIPTION

Articles of the present invention are described with reference to a hypothetical article 101 depicted in FIG. 1. Line A—A in FIG. 1 may represent, for example, a boundary or surface of an article, a plane of mirror symmetry, an axis of cylindrical or rotational symmetry, etc. In the following discussion, it is assumed that line A—A is a boundary. It will be apparent to an artisan skilled in the art that the following discussion may be extended to articles having complex geometry. Thus, the following discussion should not be construed as limiting but, rather, as a start point.

Figure 1:
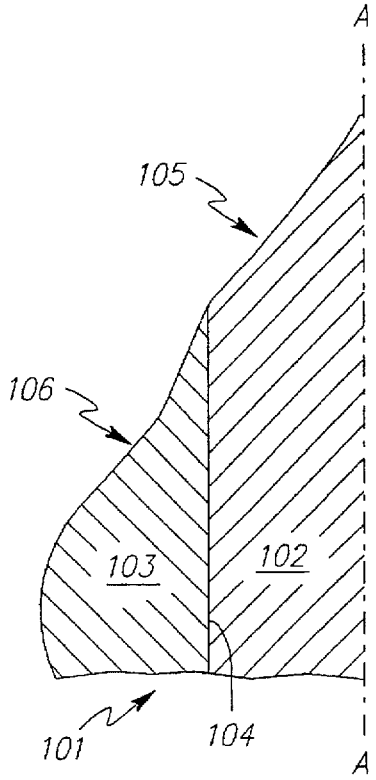
FIG. 1 is a cross-sectional schematic of a general article 101 comprising a first region 102 and a second or an at least one additional region 103 in accordance with the present invention.
Figure 2A:
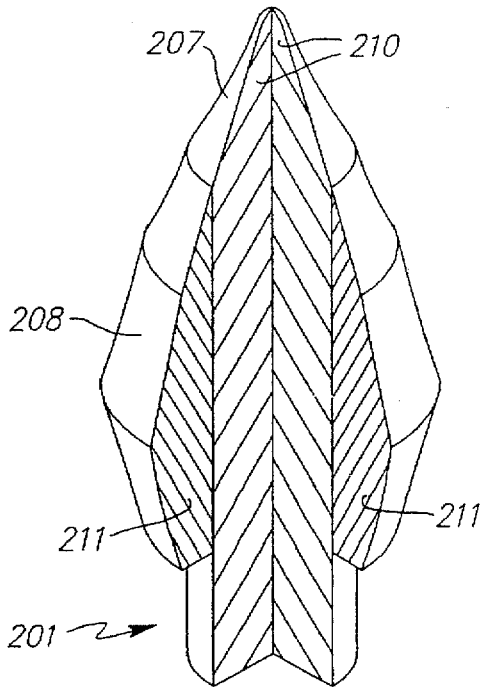
FIG. 2A, 2B, 2C, 2D, 2E, and 2F are examples of schematic cut away views of possible geometries of articles or portions of articles encompassed by the present invention.
Figure 2B:
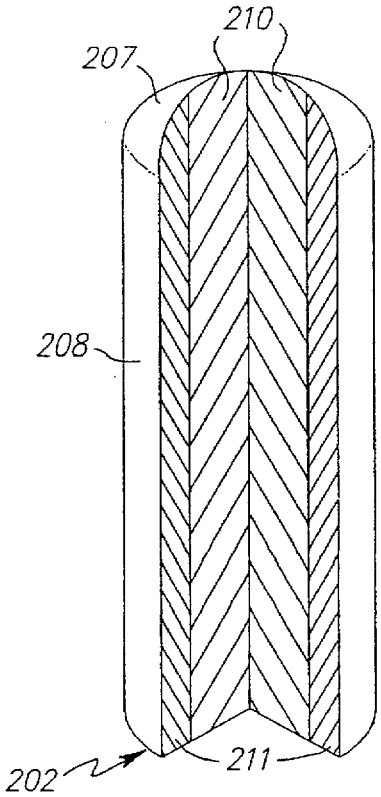
Figure 2C:
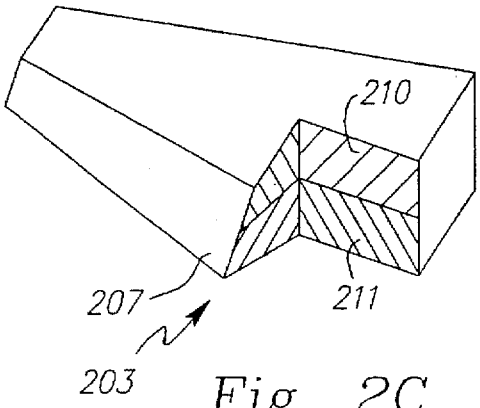
Figure 2D:
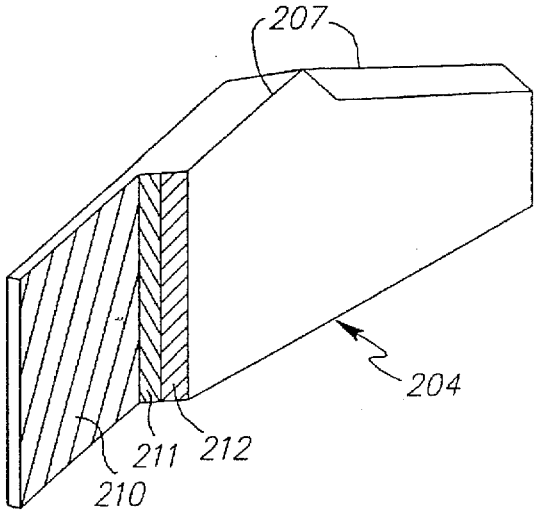
Figure 2F:
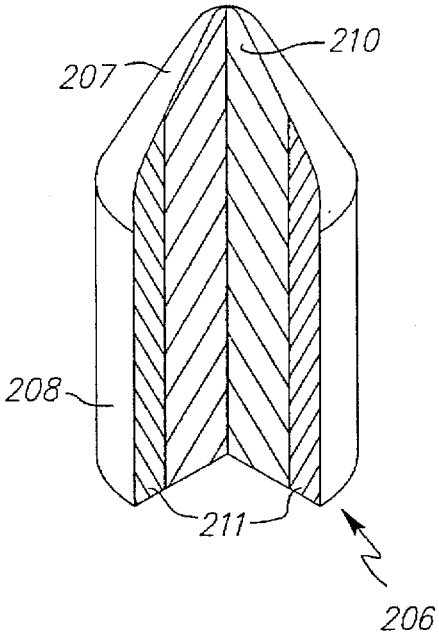
Figure 2E:
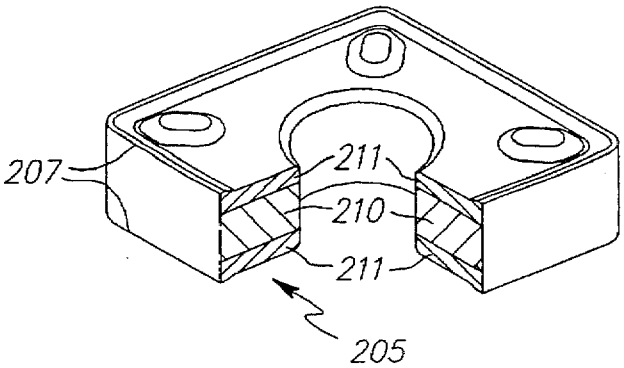

In reference to FIG. 1, article 101 has a first region 102 adjoining and integral with a second or at least one additional region 103. It will be understood by an artisan skilled in the art that multiple regions may be included in an article of the present invention. Interface 104 defines the boundary of the adjoining at least two regions. In a preferred embodiment, interface 104 is autogeneously formed. Article 101 may further comprise a leading surface 105 defined by at least a portion of the material of the first region 102 and a recessed surface 106 defined by at least a portion of the material of the second or at least one additional region 103.

Compositionally, the materials comprising the at least two regions comprise cermets. Such cermets comprise at least one of boride(s), carbide(s), nitride(s), oxide(s), silicide(s), their mixtures, their solutions or any combination of the proceeding. The metal of the at least one of boride(s), carbide(s), nitride(s), oxide(s), or silicide(s) include one or more metals from International Union of Pure and Applied Chemistry (IUPAC) groups 2, 3 (including lanthanides and actinides), 4, 5, 6, 7, 8, 9, 10, 11, 12, 13 and 14. Preferably, the cermets comprise carbide(s), their mixtures, their solutions or any combination of the proceeding. The metal of the carbide comprises one or more metals from IUPAC groups 3 (including lanthanides and actinides), 4, 5, and 6; more preferably one or more of Ti, Zr, Hf, V, Nb, Ta, Cr, Mo and W; and even more preferably, tungsten. The cermet binder for the at least two regions comprise metals, glasses or ceramics (i.e., any material that forms or assists in forming a liquid phase during liquid phase sintering). Preferably, the binder comprises one or more metals from IUPAC groups 8, 9 and 10; preferably, one or more of iron, nickel, cobalt, their mixtures, and their alloys; and more preferably, cobalt or cobalt alloys such as cobalt-tungsten alloys. Binders comprise single metals, mixtures of metals, alloys of metals or any combination of the preceding.

Dimensionally, the size of the ceramic component, preferably carbide(s), of the at least two regions may range in size from submicrometer to about 420 micrometers or greater. Submicrometer includes ultrafine structured and nanostructured materials. Nanostructured materials have structural features ranging from about 1 nanometer to about 300 nanometers or more. The average grain size of the ceramic component, preferably carbide(s), in the first region is greater than the average grain size of the ceramic component, preferably carbide(s), in the second region.

In a preferred embodiment, the grain size of the ceramic component, preferably carbide(s) and more preferably, tungsten carbides, of the first region ranges from about submicrometer to about 30 micrometers or greater with possibly a scattering of grain sizes measuring, generally, in the order of about 40 micrometers. Preferably, the grain size of the ceramic component of the first region ranges from about 0.5 micrometer to about 30 micrometers or greater with possibly a scattering of grain sizes measuring, generally, in the order of about 40 micrometers, while the average grain size ranges from about 0.5 micrometers to about 12 micrometers; preferably, from about 3 micrometers to about 10 micrometers; and more preferably, from about 5 micrometers to about 8 micrometers. Likewise, the grain size of the ceramic component of the second region ranges from about submicrometer to 30 micrometers or greater with possibly a scattering of grain sizes measuring, generally, in the order of about 40 micrometers. Preferably, the grain size of the ceramic component of the second region ranges from about 0.5 micrometer to about 30 micrometers or greater with possibly a scattering of grain sizes measuring, generally, in the order of about 40 micrometers, while the average grain size ranges from about 0.5 micrometer to about 8 micrometers; preferably, from about 1 micrometer to about 5 micrometers; and more preferably, from about 2 micrometers to about 5 micrometers.

In general, the ceramic component grain size and the binder content may be correlated to the mean free path of the binder by quantitative metallographic techniques such as those described in "Metallography, Principles and Practice" by George F. Vander Voort (copyrighted in 1984 by McGraw Hill Book Company, New York, N.Y.). Other methods for determining the hard component grain size included visual comparison and classification techniques such as those discussed in ASTM designation: B 390-92 entitled "Standard Practice for Evaluating Apparent Grain Size and Distribution of Cemented Tungsten Carbide," approved January 1992 by the American Society for Testing and Materials, Philadelphia, Pa. The results of these methods provide apparent grain size and apparent grain size distributions.

In a preferred embodiment relating to ferromagnetic binders, the average grain size of the ceramic component, preferably carbide and more preferably tungsten carbide, may be correlated to the weight percent binder ($X_b$), the theoretical density (ρth, grams per cubic centimeter) and the coercive force (Hc, kiloampere-turn per meter (kA/m)) of a homogeneous region of a sintered article as described by R. Porat and J. Malek in an article entitled "Binder Mean-Free-Path Determination in Cemented Carbide by Coercive Force and Material Composition," published in the proceedings of the Third International Conference of the Science of Hard Materials, Nassau, the Bahamas, Nov. 9–13, 1986, by Elsevier Applied Science and edited by V. K. Satin. For a cobalt bound tungsten carbide article, the calculated average grain size, d micrometers, of the tungsten carbide is given by equation 1, $$d = 0.3\left[\frac{80}{H_c}\right]^{(164.822/X_{Co}\rho th)^{1/3}} \tag{1}$$

In a preferred embodiment, the ratio of the average grain size of the ceramic component of the first region to that of the second region ranges from about 1.5 to about 12 and, preferably ranges from about 1.5 to about 3.

In a preferred embodiment, the binder content of the first region comprises, by weight, from about 2 percent to about 25 percent or more; preferably, from about 5 percent to about 10 percent; and more preferably, from about 5.5 percent to about 8 percent. Likewise, the binder content of the at least one additional region ranges, by weight, from about 2 percent to about 25 percent and preferably, from about 8 percent to about 15 percent. The binder content of the second region is greater than that of the first region.

In a preferred embodiment, the combination of carbide grain size and binder content may be correlated to a binder mean free path size, λ, as discussed generally by Vander Voort and particularly for ferromagnetic materials by Porat and Malek. The binder mean free path (λmicrometers) in an article having a ferromagnetic metallic binder is a function of the weight percent binder ($X_b$), coercive force ($H_c$, kiloampere-turn per meter (kA/m), and the theoretical density (ρth, grams per cubic centimeter) of a homogeneous region of the densified article. For a cobalt bound tungsten carbide article, the mean free path, λ, of the cobalt binder is given by the equation 2, $$\lambda = \frac{0.3\,X_{Co}\rho th}{890 - X_{Co}\rho th}\left(\frac{80}{H_c}\right)^{(164.822/X_{Co}\rho th)^{1/3}} \tag{2}$$

In a preferred embodiment, the binder mean free path size in the first region ranges from about 0.5 micrometers to about 2.5 micrometers, and preferably comprises about 0.8 micrometers while the mean free path size of the at least one additional region ranges from about 0.5 micrometers to about 1.5 micrometers.

The solid geometric shape of an article may be simple or complex or any combination of both. Solid geometric shapes include cubic, parallelepiped, pyramidal, frustum of a pyramid, cylinder, hollow cylinder, cone, frustum of a cone, sphere (including zones, segments and sectors of a sphere and a sphere with cylindrical or conical bores), toms, sliced cylinder, ungula, barrel, prismoid, ellipsoid and combinations thereof. Likewise, cross-sections of such articles may be simple or complex or combinations of both. Such shapes may include polygons (e.g., squares, rectangles, parallelograms, trapezium, triangles, pentagons, hexagons, etc.), circles, annulus, ellipses and combinations thereof. FIGS. 2A, 2B, 2C, 2D, 2E and 2F illustrate combinations of a first region 210, a second region 211 and in some case a third region 212 (FIG. 2D) incorporated in various solid geometries. These figures are cut-away sections of the articles or portions of articles (conical cap or conical hybrid or scarifier conical in FIG. 2A; compact in FIG. 2B; grader or scraper or plow blade in FIG. 2C; roof bit borer in FIG. 2D; cutting insert for chip forming machining of materials in FIG. 2E; and conical plug or insert in FIG. 2F) and further demonstrate a leading edge or surface 207, and an outer surface 208.

Again, with reference to FIG. 1, the interface 104 defining the boundary between the first region 102 and the second region 103 may divide the article 101 in a symmetric manner or an asymmetric manner or may only partially divide the article 101. In this manner, the ratios of the volume of the first region 102 and the at least one additional region 103 may be varied to engineer the most optimum bulk properties for the article 101. In a preferred embodiment, the ratio of the volume of the first region 102 to the volume of the second region 103 ranges from about 0.25 to about 4; preferably, from about 0.33 to about 2.0; and more preferably, from about 0.4 to about 2.

The novel articles of the present invention are formed by providing a first powder blend and a second or at least one additional powder blend. It will be apparent to artisan in the art that multiple powder blends may be provided. Each powder blend comprises at least one ceramic component, at least one binder, at least one lube (an organic or inorganic material that facilitates the consolidations or agglomeration of the at least one ceramic component and at least one binder), and optionally, at least one surfactant. Methods for preparing each powder blend may include, for example, milling with rods or cycloids followed by mixing and then drying in a sigma-blade type dryer or spray dryer. In any case, each powder blend is prepared by a means that is compatible with the consolidation or densification means or both when both are employed.

A first powder blend having a pre-selected ceramic component, preferably carbide(s), grain size or grain size distribution and at least one additional powder blend having a finer ceramic component, preferably carbide(s), grain size or grain size distribution are provided. The at least two powder blends are at least partially juxtaposed. The at least partial juxtaposition provides or facilitates the formation of the novel articles having at least two regions having at least one different property after consolidation and densification by, for example, sintering.

A first powder blend comprises a ceramic component, preferably carbide(s), having a coarse particle size relative to the at least one additional powder blend. Particle sizes may range from about submicrometer to about 420 micrometers or greater; preferably, grain sizes range from about submicrometer to about 30 micrometers or greater with possibly a scattering of particle sizes measuring, generally, in the order of about 40 micrometers. Submicrometer includes ultrafine structured and nanostructured materials. Nanostructured materials have structural features ranging from about 1 nanometer to about 100 nanometers or more. Preferably, the particle size of the ceramic component of the first powder blend ranges from about 0.5 micrometer to about 30 micrometers or greater with possibly a scattering of grain sizes measuring, generally, in the order of about 40 micrometers, while the average particle size may range from about 0.5 micrometers to about 12 micrometers; preferably, from about 3 micrometers to about 10 micrometers; and more preferably, from about 5 micrometers to about 8 micrometers.

The ceramic component of a first powder blend may comprise boride(s), carbide(s), nitride(s), oxide(s), silicide (s), their mixtures, their solutions or any combinations of the preceding. The metal of the boride(s), carbide(s), nitride(s), oxide(s) or silicide(s) comprises one or more metals from IUPAC groups 2, 3 (including lanthanides and actinides), 4, 5, 6, 7, 8, 9, 10, 11, 12, 13, and 14. Preferably the ceramic component comprises carbide(s), their mixtures, or any combination of the preceding. The metal of the carbide comprise one or more metals from IUPAC groups 3 (including lanthanides and actinides), 4, 5, and 6; more preferably one or more of Ti, Zr, Hf, V, Nb, Ta, Cr, Mo and W; and .even more preferably tungsten.

A binder of a first powder blend may comprise any material that is compatible with the formation process and does not adversely affect the performance of the article for its intended application. Such materials include metals, ceramics, glasses, or any combination of the preceding including mixtures, solutions, and alloys. Examples of metals suitable for use as binders include one or more metals of IUPAC groups 8, 9 and 10; preferably, one or more of Fe, Co. Ni, their mixtures, their alloys and combinations thereof; and more preferably, cobalt or cobalt alloys such as cobalt-tungsten alloys. A metal binder may include powder metal mixtures or alloy powder or both.

A binder amount of a first powder blend is pre-selected to tailor the properties, for example, to provide sufficient wear resistance of the resultant first region of an article for its intended use. It has been discovered that the pre-selected binder content may range, by weight, from about 2 percent to about 25 percent or more; more preferably, from about 5 percent to about 15 percent; even more preferably, from about 9 percent to about 10 percent.

A binder in a first powder blend may be any size that facilitates the formation of an article of the present invention. Suitable sizes have an average particle size less than about 5 micrometers; preferably, less than about 2.5 micrometers; and more preferably, less than about 1.8 micrometers.

One constraint on the second powder blend is that the average particle size of the ceramic component is less or smaller than the average particle size of the ceramic component of the first powder blend. As with the first powder blend, the particle size of the ceramic component, preferably carbide(s), may range from about submicrometer to about 420 micrometers or greater. Submicrometer includes ultrafine structured and nanostructured materials. Nanostructured materials have structural features ranging from about 1 nanometer to about 100 nanometers or more. Preferred particle sizes range from about submicrometer to about 30 micrometers, with possibly a scattering of particle sizes measuring, generally, in the order of about 40 micrometers. Preferably, the particle size of the ceramic component of the second powder blend ranges from about one micrometer to about 30 micrometers or greater with possibly a scattering of grain sizes measuring, generally, in the order of about 40 micrometers. Unlike the first powder blend, the average grain size of the ceramic component of the second powder blend, preferably carbide(s) and more preferably tungsten carbide, may range from about 0.5 micrometer to about 8 micrometers; preferably, from about 1 micrometer to about 5 micrometers; and more preferably, from about 2 to about 5 micrometers.

The ratio of the average ceramic component particle size of the first powder blend and the average ceramic component particle size of the second powder blend is selected to both facilitate the formation of an article of the present invention and optimize the performance of the resultant article. Thus, it is believed that the ratio of the average coarse particle size to the average fine particle size may range from about 1.5 to about 12, with a preferred ratio ranging from about 1.5 to about 3.

The chemistry of the ceramic component of the second or at least one additional powder blend may be substantially the same as or substantially different from the chemistry of the first powder blend. Thus, the chemistry includes all the enunciated chemistries of the first powder blend.

Likewise, the chemistry of the binder of the second powder blend may be substantially the same as or substantially different from the chemistry of the binder of the first powder blend. Thus, the chemistry includes all the enunciated chemistries of the first powder blend.

The binder content of each powder blend is selected both to facilitate formation of an article and provide optimum properties to the article for its particular application. Thus, the binder content of the first powder blend may be greater than, less than or substantially equivalent to the binder content of the second powder blend. Preferably, the binder content of the second powder blend ranges, by weight, from about zero (0) to about two (2) percentage points different from the percentage of the pre-selected binder content of the first powder blend; more preferably, about 0.5 percentage points different from the percentage of the pre-selected binder content of the first powder blend. In a more preferred embodiment, the binder content of the second powder blend is less than that of the first powder blend. For example, if the preselected binder content of the first powder blend is by weight, about 9.5 percent, then the binder content of the second powder blend may range from about 7.5 percent to about 11.5 percent, preferably from about 9 percent to about 10 percent, more preferably from about 7.5 percent to about 9.5 percent and even more preferably from about 9 percent to about 9.5 percent.

The at least two powder blends are provided in any means that allows at least a portion of each to be at least partially juxtaposed. Such means may include, for example, pouring; injection molding; extrusion, either simultaneous or sequential extrusion; tape casting; slurry casting; slip casting; sequential compaction; co-compaction; or and any combination of the preceding. Some of these methods are discussed in U.S. Pat. Nos. 4,491,559; 4,249,955; 3,888,662; and 3,850,368, which are incorporated by reference in their entirety in the present application.

During the formation of a green body, the at least two powder blends may be maintained at least partially segregated by a providing means or by a segregation means or both. Examples of providing means may include, for example, the methods discussed above while segregation means may include a physically removable partition or a chemically removable partition or both.

A physically removable partition may be as simple as a paper or other thin barrier that is placed into a die or mold during the charging of the at least two powder blends and which is removed from the die or mold after powder blend charging and prior to powder blend densification. More sophisticated physically removable partitions may include concentric or eccentric tubes (e.g., impervious or pervious sheets, screens or meshes, whether metallic or ceramic or polymeric or natural material, or any combination of the preceding). The shapes of physically removable partitions may be any that facilitate the segregation of the at least two powder blends.

A chemically removable partition includes any partition, whether in a simple or complex form or both, or pervious or impervious or combinations of both, that may be removed from or consumed by the segregated at least two powder blends by a chemical means. Such means may include leaching or pyrolysis or fugitive materials or alloying or any combination of the preceding. Chemically removable partitions facilitate the formation of articles of the present invention wherein the at least two regions, cross-sectionally as well as in regard to the solid geometry, comprise complex shapes.

In an embodiment of the present invention, the segregated and at least partially juxtaposed at least two powder blends are densified by, for example, pressing including, for example, uniaxial, biaxial, triaxial, hydrostatic, or wet bag either at room temperature or at elevated temperature.

In any case, whether or not consolidated, the solid geometry of the segregated and at least partially juxtaposed at least two powder blends may include: cubes, parallelepipeds, pyramids, frustum of pyramid, cylinders, hollow cylinders, cones, frustum of cones, spheres, zones of spheres, segments of spheres, sectors of spheres, spheres with cylindrical bores, spheres with conical bores, torus, sliced cylinders, ungula, barrels, prismoids, ellipsoids, and combinations of the preceding. To achieve the direct shape or combinations of shapes, the segregated and at least partially juxtaposed at least two powder blends may be formed prior to or after densification or both. Prior forming techniques may include any of the above mentioned providing means as well as green machining or plastically deforming the green body or their combinations. Forming after densification may include grinding or any machining operations.

The cross-sectional profile of a green body may be simple or complex or combinations of both. Shapes include polygons such as squares, rectangles, parallelograms, trapezium, triangles, pentagons, hexagons, etc.; circles; annulus; ellipses; etc.

The green body comprising the segregated and at least partially juxtaposed at least two powder blends is then densified by liquid phase sintering. Densification may include any means that is compatible with making an article of the present invention. Such means include hot pressing, vacuum sintering, pressure Sintering, hot isostatic pressing (HIPping), etc. These means are performed at a temperature and/or pressure sufficient to produce a substantially theoretically dense article having minimal porosity. For example, for tungsten carbide-cobalt articles, such temperatures may include temperatures ranging from about 1300° C. (2372° F.) to about 1650° C. (3002° F.); preferably, from about 1350° C. (2462° F.) to about 1537° C. (2732° F.); and more preferably, from about 1500° C. (2732° F.) to about 1525° C. (2777° F.). Densification pressures may range from about zero kPa (zero psi) to about 206,850 kPa (30,000 psi). For carbide articles, pressure sintering may be performed at from about 1,723 kPa (250 psi) to about 13,790 kPa (2000 psi) at temperatures from about 1370° C. (2498° F.) to about 1540° C. (2804° F.), while HIPping may be performed at from about 58,950 kPa (10,000 psi) to about 206,850 kPa (30,000 psi) at temperatures from about 1,310° C. (2390° F.) to about 1430° C. (2606° F.).

Densification may be done in the absence of an atmosphere, i.e., vacuum; in an inert atmosphere, e.g., one or more gasses of IUPAC group 18; in nitrogenous .atmospheres, e.g., nitrogen, forming gas (96% nitrogen, 4% hydrogen), ammonia, etc.; in a carburizing atmosphere; or in a reducing gas mixture, e.g., $H_2/H_2O$, $CO/CO_2$, $CO/H_2/CO_2/H_2O$, etc.; or any combination of the preceding.

In an effort to explain the workings of the present invention, but without wishing to be bound by any particular theory or explanation for the present invention, it appears as though when a green body is liquid phase sintered, binder from the first powder blend migrates by capillary wetting into the second powder blend or the ceramic component of the second powder blend is transported by a dissolution, diffusion, and precipitation mechanism to the first powder blend or both.

With regard to the capillary migration mechanism, metal binders, particularly in carbide-cobalt systems, may wet ceramic component particles readily. The particle size difference between the first powder blend and the second powder blend translates into a corresponding difference in effective capillary size of the at least two powder blends. The effective capillary size in the second powder blend (e.g., the powder blend with the fine particle size) would be smaller and thus provide a driving force for a molten binder to migrate from the first powder blend to the second powder blend.

With regard to the dissolution, diffusion, and precipitation mechanism, the particle size difference of the at least two powder blends translates into a corresponding difference in effective particle surface area of the at least two powder blends. The effective surface area of the second powder blend (i.e., the fine particle powder) would be greater and thus there would be a driving force to reduce that area during densification. As a result, finer particles would then preferentially dissolve in the molten binder, diffuse to the region of the first powder blend, and precipitate onto the coarser particles of the first powder blend.

The present invention is illustrated by the following Examples. These Examples are provided to demonstrate and clarify various aspects of the present invention. The Examples should not be construed as limiting the scope of the claimed invention.

EXAMPLE 1

The present Example demonstrates, among other things, a method of making an article, an article, and a method of using an article of the present invention. More particularly, the present Example demonstrates the formation of an article having a first region and a second region, the first region comprising a coarse grain size carbide material and the second region comprising a fine grain size carbide material. The juxtaposing of the first with a predetermined region with a predetermined exterior or surface profile in a single article facilitates its use for the removal of material, and specifically, the removal of coal in a mining operation. This Example describes the method of making the article, the characterization of the article and a description of the method of using the article.

METHOD OF MAKING

To make articles according to the present Example and the present invention, a granulated first powder blend and a granulated second powder blend were separately prepared. The first powder blend (depicted as 314 in FIGS. 3A, 3B and 3C) comprised, by weight, about 87.76 percent macrocrystalline tungsten carbide (Kennametal Inc. Fallon, Nev.), about 9.84 percent commercially available extra fine cobalt binder, about 2.15 percent paraffin wax lubricant, and about 0.25 percent of surfactant.

A portion of the first powder blend was then sintered and the tungsten carbide average grain size, which had an observed grain size ranging from about 1 micrometer to about 25 micrometers with the possibility of scattered grains having a grain size, generally, in the order of about 40 micrometers, was calculated at about 6.7 micrometers by Equation (1) after measuring the sintered articles coercive force ($H_c$) and binder content ($X_{co}$).

The second powder blend (depicted as 313 in FIGS. 3A, 3B and 3C) comprised, by weight, about 88.82 percent macrocrystalline tungsten carbide (Kennametal Inc., Fallon, Nev.), about 8.78 percent commercially available cobalt binder, about 2.15 percent paraffin wax lubricant, and about 0.25 percent of a surfactant surfactant. The observed grain size of the tungsten carbide in a sintered piece ranged from about 1 to about 9 micrometers with the possibility of scattered grains having a grain size, generally, in the order of about 40 micrometers and had a calculated average grain size of about 2.8 micrometers as determined by Equation (1).

Figure 3A:
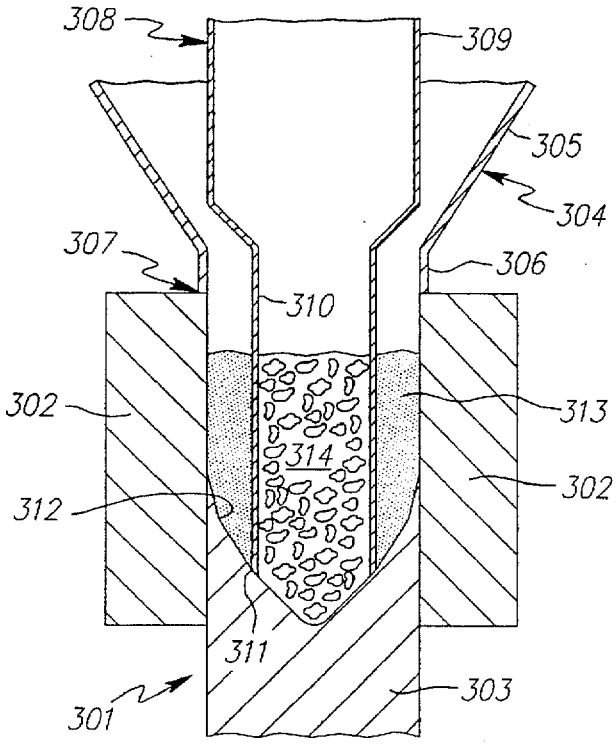
FIG. 3A is a cross-sectional schematic of a charging configuration 301 corresponding to the methods of Example 1.
Figure 3B:
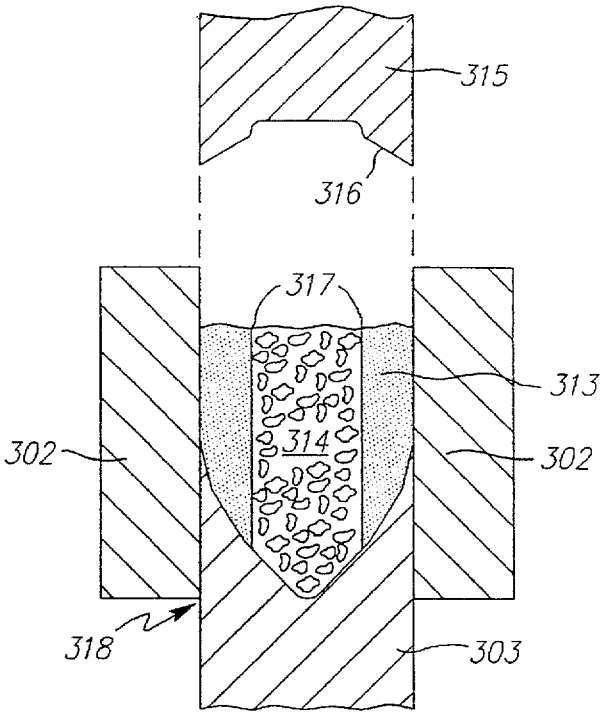
FIG. 3B is a cross-sectional schematic of a pressing configuration corresponding to the methods of Example 1.
Figure 3C:
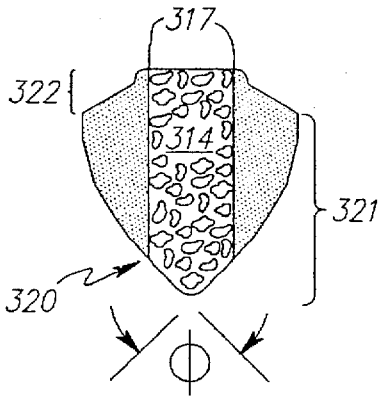
FIG. 3C is a cross-sectional schematic of a green body 320 made by the methods of Example 1.

The first powder blend 314 and the second powder blend 313 were then charged into a die cavity having an about 19 mm (0.75 inch) diameter using charging configuration 301 depicted schematically in FIG. 3A. Charging configuration 301 included engagement of a lower ram 303 with a side cylindrical wall of the die 302, the placement of an outer portion charging funnel 304 having a contact point 307 between the outer portion charging funnel and the die cavity, an inner portion charging funnel 308 contacting forward portion defining surface 312 via physically removable portion 310, which had a diameter measuring about 10 mm (0.39 inch), at contact point 311 of the lower ram 303. About 8.4 grams of the first powder blend 314 were poured into the inner portion charging funnel 308. About 18.6 grams of the second powder blend 313 were charged into the outer portion charging funnel 304. After both the first powder blend 314 and the second powder blend 313 had been placed within the die cavity, the inner and the outer charging funnels were removed to form an interface 317 between the first powder blend 314 and the second powder blend 313. An upper ram 315 having a rear portion defining surface 316 was then engaged at about room temperature with the first powder blend 314 and the second powder blend 313 to a load of about 31,138 newtons (N) (7,000 pounds (lbs.)). After the load was removed, green body 320 was ejected from the die cavity and had a forward portion 321 defined by a lower ram 303 and a rear portion defined by the upper ram 315. Further, the green body 320 comprised compacted first powder blend 314 and second powder blend 313. This operation was repeated until a sufficient number (about 72) of green bodies comprising the first powder blend 314 and the second powder blend 313 had been formed. Additionally, several bodies comprised only of the first powder blend 314 and other bodies comprised only of the second powder blend 313 were formed. These bodies were used as control samples during sintering of the green bodies 320 to determine the types of changes that may occur as a result of the co-densification of a first powder blend 314 contacting a second powder blend.

Once a sufficient number of green bodies 320 had been formed, green bodies 320 and the control samples were placed in an Ultra-Temp pressure sintering furnace (Ultra-temp Corporation, Mt. Clement, Mo.). The furnace and its contents were evacuated to about five (5) torr and then raised from about room temperature to about 177° C. (350° F.) at a rate of about 3.3° C. (6° F.) per minute under vacuum; held at about 177° C. (350° F.) for about 15 minutes; heated from about 177° C. (350° F.) to about 371° C. (700° F.) at about 3.3° C. (6° F.) per minute; held at about 371° C. (700° F.) for about 90 minutes; heated from about 371° C. (700° F.) to about 427° C. (800° F.) at about 1.7° C. (3° F.) per minute; held at about 427° C. (800° F.) for about 45 minutes; heated from about 427° C. (800° F.) to about 538° C. (1000° F.) at about 1.4° C. per minute; held at about 538° C. (1000° F.) for about 12 minutes heated from about 538° C. (1000° F.) to about 593° C. (1000° F.) at about 1.4° C. (2.5° F.) per minute and then from about 593° C. (1100° F.) to about 1,121° C. (2050° F.) at about 4.4° C. (8° F.) per minute; held at about 1,121° C. (2050° F.) for about 30 minutes under a vacuum ranging from about 13 micrometers to about 29 micrometers; heated from about 1,121° C. (2050° F.) to about 1,288° C. (2350° F.) at about 4.4° C. (8° F.) per minute; held at about 1,288° C. (2350° F.) for about 30 minutes while argon was introduced to about 15 torr; heated from about 1,288° C. (2350° F.) to about 1,510° C. (2750° F.) at about 3.3° C. (6° F.) per minute while argon was introduced to about a pressure of about 5,516 kPa (800 psi); held at about 1,510° C. (2750° F.) for about 5 minutes; and then the power to the furnace was turned off and the furnace and its contents were allowed to cool to about room temperature at about 5.6° C. (10° F.) per minute.

Several of the sintered articles (now having diameters of about 15.9 mm (0.625 inch)and included tip angles, $\phi$, of about 75°), including sintered control samples for the sintered only first powder blend and the sintered only second powder blend, were characterized using metallography, wet chemical analysis, magnetic properties characterization, hardness, and energy dispersive x-ray analysis (EDS).

Table I sets forth the results of characterization of the first region and the second region of articles made in accordance with the present Example and the sintered control samples of the only first powder blend and only second powder blend. The results of wet chemical analysis indicate that cobalt binder migrated from the first powder blend to the second powder blend during the densification of the green body to form the article. This migration of the cobalt binder had an effect on the hardness of the first region relative to the sintered control samples of only first powder blend and the second portion relative to the sintered only second powder blend.

Figure 4A:
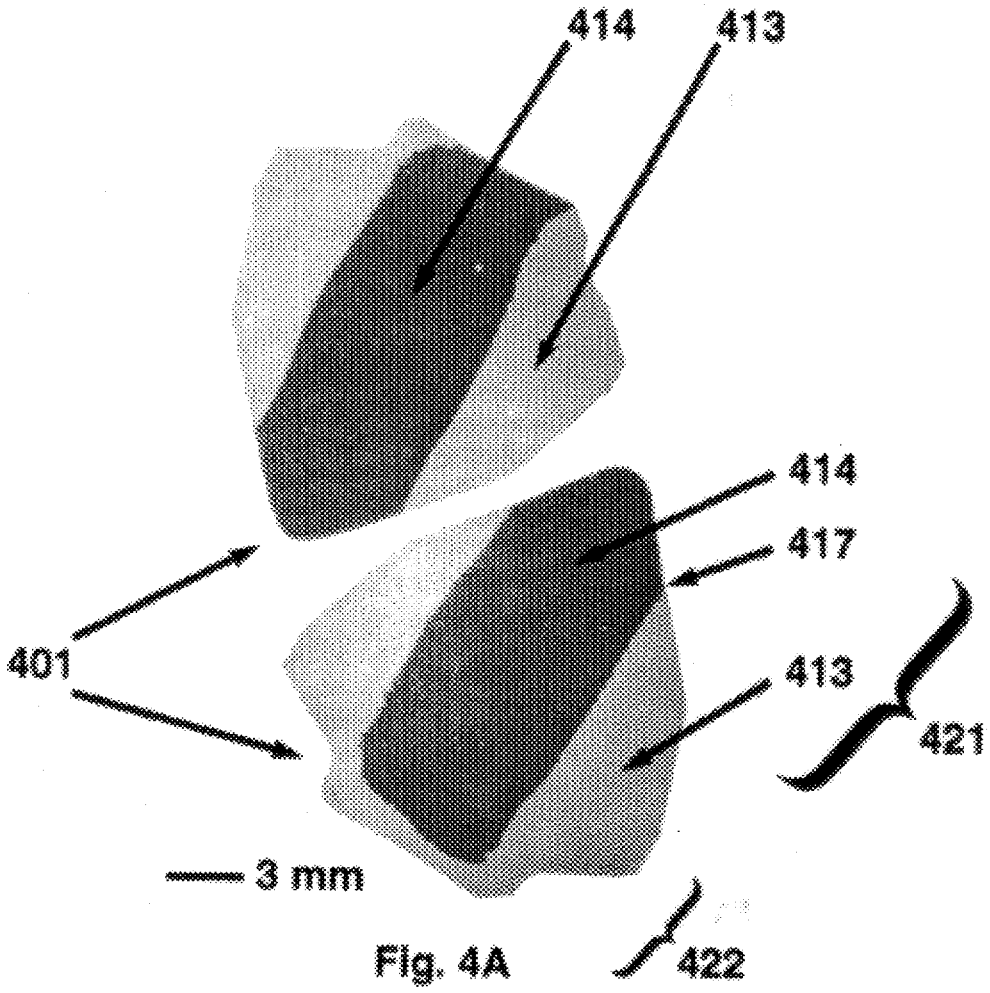
FIG. 4A is a photomicrograph taken at a magnification of about 3.4× of a longitudinal cross-section through sintered articles 401 made according to the methods of Example 1.
Figures 4B, 4C, 4D:
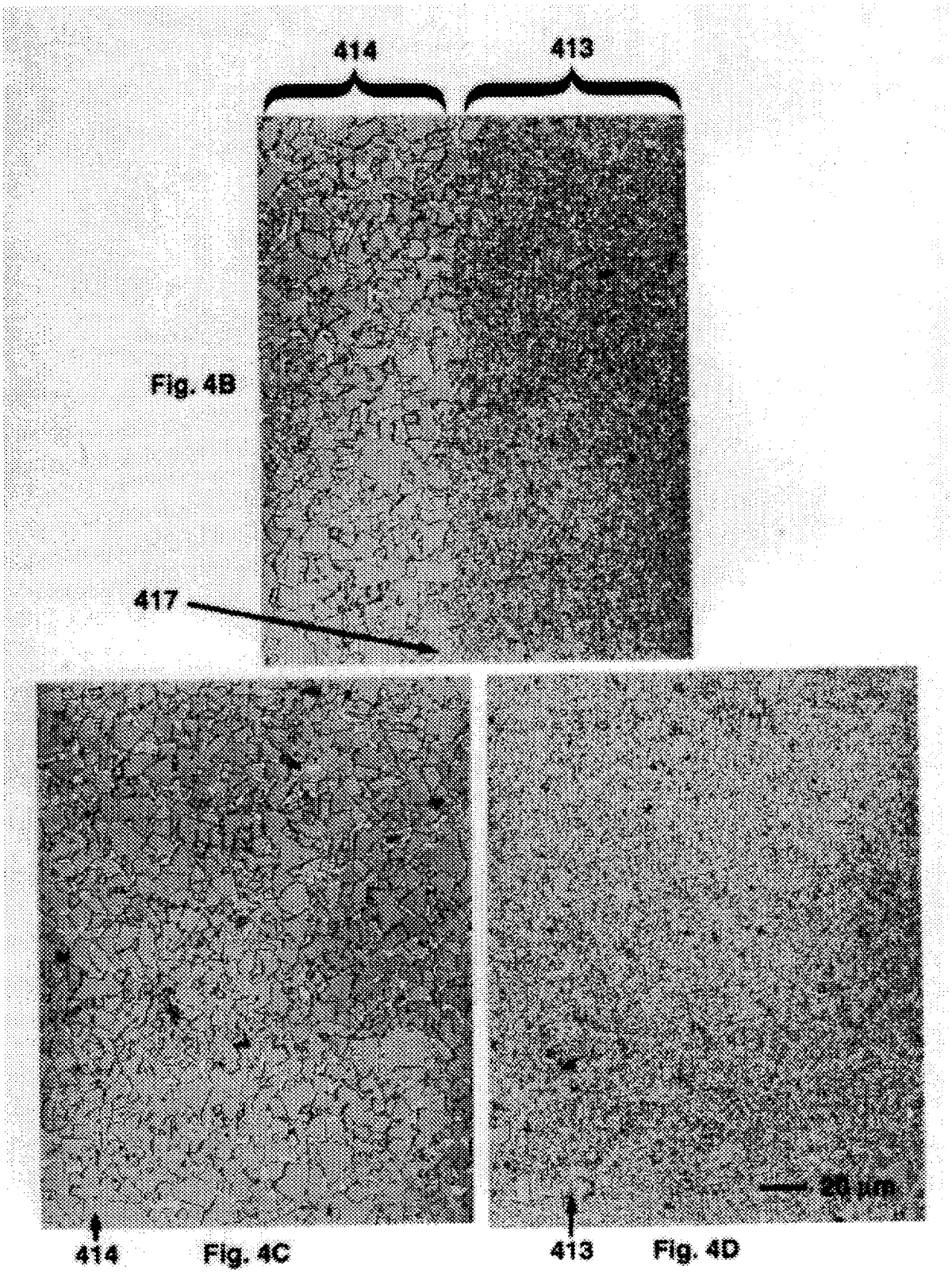
FIGS. 4B, 4C, and 4D are respectively photomicrographs taken at a magnification of about 500× of an interface 417 between a first region 414 and a second region 413, a first region 414, and a second region 413 of an article made according to the methods of Example 1.
Figure 4E:
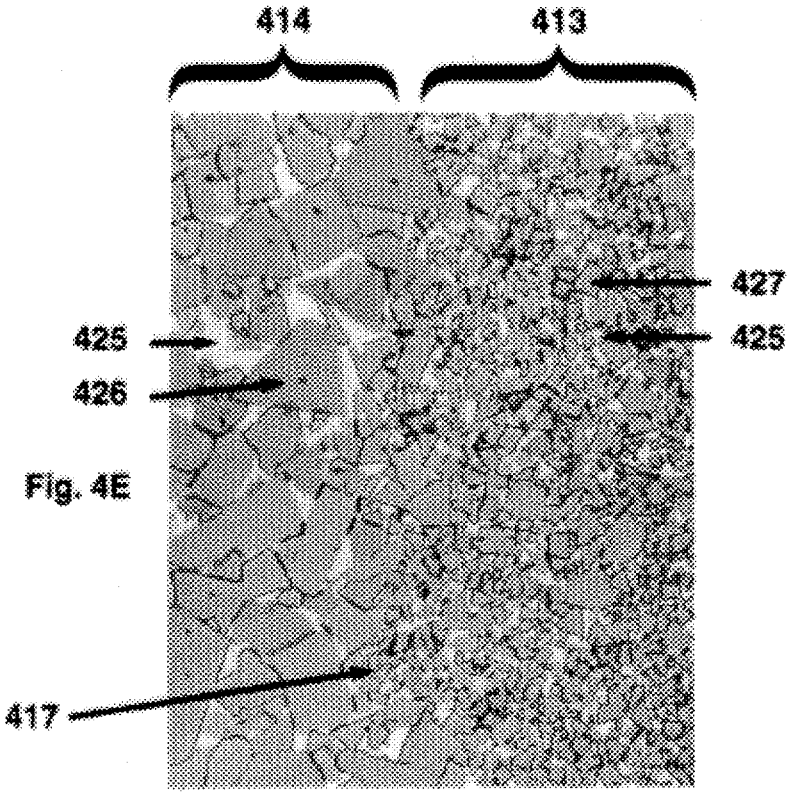
FIG. 4E, 4F and 4G are respectively photomicrographs taken at a magnification of about 1,500× of an interface 417 between a first region 414 and a second region 413, a first region 414, and a second region 413 of an article made according to the methods of Example 1.
Figure 4F:
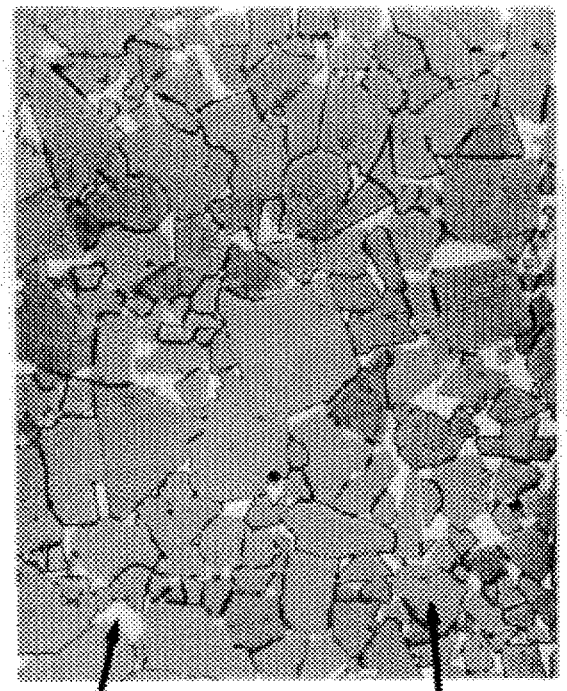
Figure 4G:
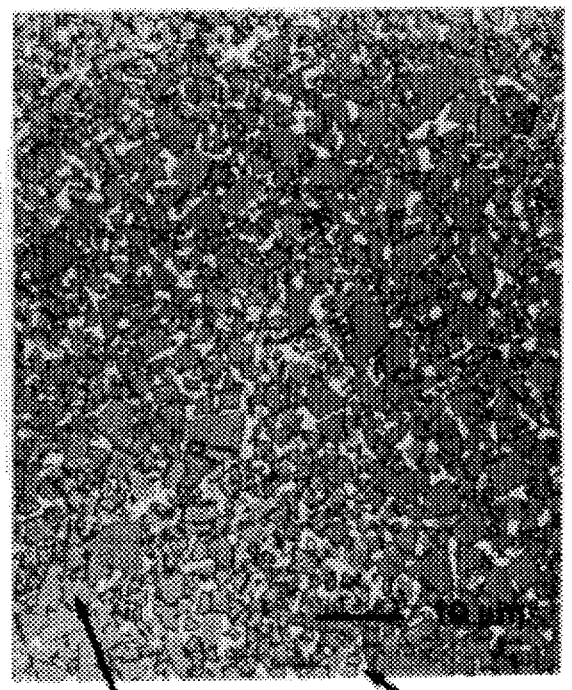

FIG. 4A is a photomicrograph at about 3.4× of longitudinal cross sections of sintered article 401 having a first portion 414 contacting a second portion 413 at an interface 417. A forward region 421 corresponds to the forward region of a green body and the rear portion 422 corresponds to the rear portion of a green body. Examination of the interface 417 between the first region 414 and the at least one additional region 413 at a magnification of about 500× is shown in FIG. 4B, while at a magnification of about 1500× in FIG. 4E. FIGS. 4C and 4D are photomicrographs of a first region 414 and an second region 413 at a magnification of about 500×, while FIGS. 4F and 4G are photomicrographs of the first region 414 and the second region 413 at a magnification of about 1500×. The constituents of the first region 414 and the second region 413 are identified in FIGS. 4E, 4F and 4G and include a cobalt alloy binder 425, coarse grain tungsten carbide 426 and the fine tungsten grain carbide 427. The autogeneously formed bond line 417 is clearly seen in FIG. 4E as a sudden change in tungsten carbide grain size. There is an excellent autogeneously produced metallurgical bond which is free of cracks and inclusions. These dense, sintered articles are also free of eta-phase and C porosity.

Figure 5A:
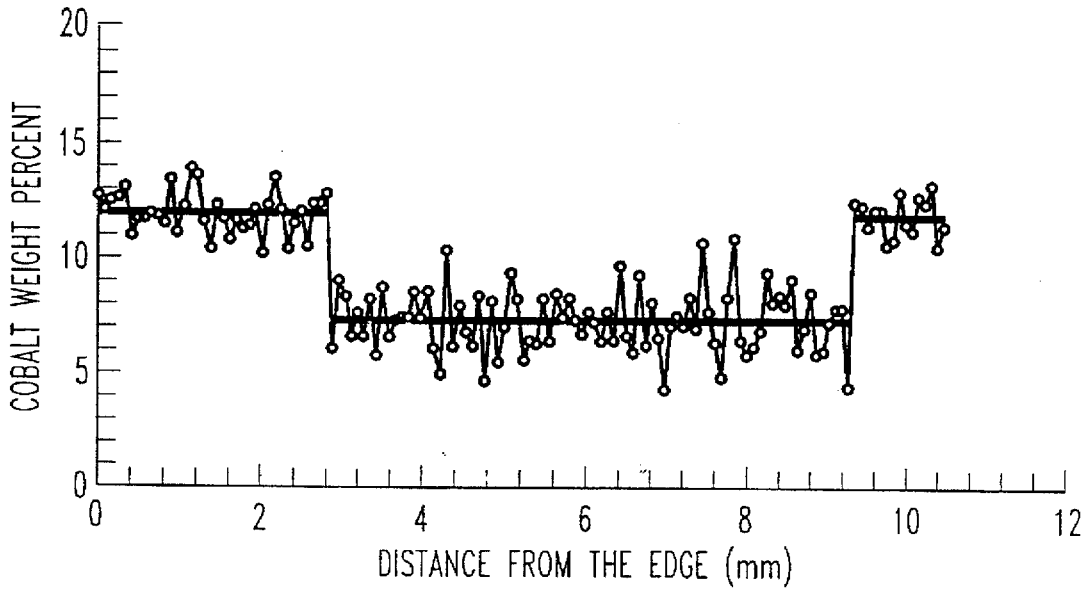
FIGS. 5A and 5B correspond to the results of binder concentration determinations using EDS techniques as a function of distance at two diameters of an article made according to the methods of Example 1.
Figure 5B:
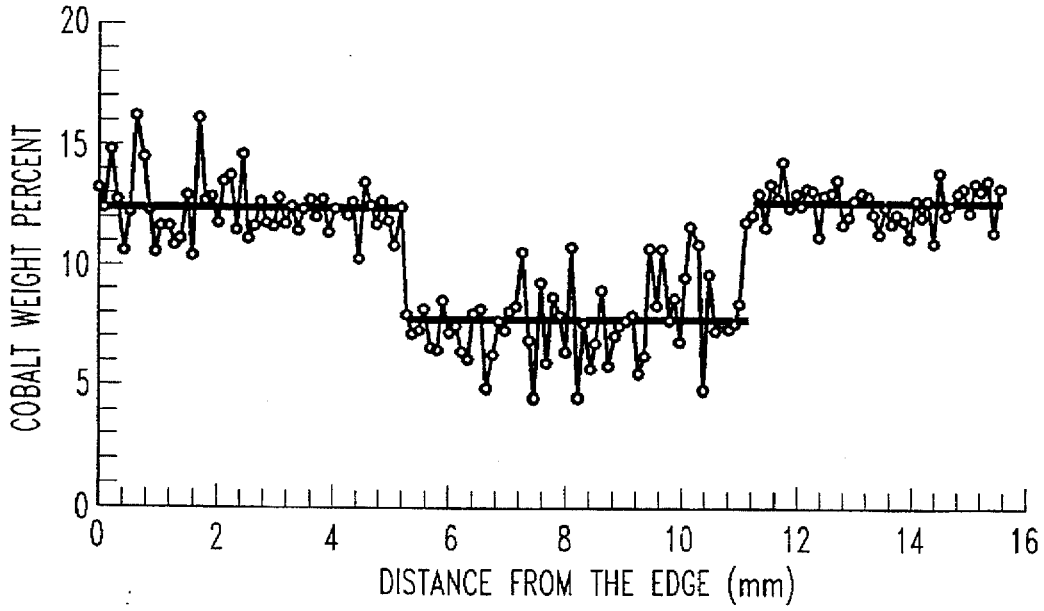

To quantify the cobalt distribution within the article made by the method of the present Example, a mounted and polished sample was analyzed by standardless spot probe analysis using energy dispersive x-ray analysis (EDS) at two different diameters of an article. Specifically, a JSM-6400 scanning electron microscope (Model No. ISM64-3, JEOL LTD, Tokyo, Japan) equipped with a $LaB_6$ cathode electron gun system and an energy dispersive x-ray system with a silicon-lithium detector (Oxford Instruments Inc., Analytical System Division, Microanalysis Group, Bucks, England) at an accelerating potential of about 20 keV was used. The scanned areas measured about 125 micrometers by about 4 micrometers. Each area was scanned for equivalent time intervals (about 50 seconds live time). The step size between adjacent areas was about 0.1 mm (0.004 inch). FIGS. 5A and 5B show the results of this standardless analysis as well as the average across a region. FIG. 5A corresponds to the results of a spot probe analysis done at a diameter of about 10.5 mm (0.413 inch) and shows a stepwise gradation of cobalt content from the first region (average about 11.9 wt %) to the second region average to about 7.2 wt %). Likewise, FIG. 5B shows the results of spot probe analysis for a diameter measuring about 15.5 mm (0.610 inch) and

TABLE I

CHARACTERIZATION RESULTS OF REGIONS OF AN ARTICLE MADE IN ACCORDANCE WITH EXAMPLE 1 AND CONTROLS SAMPLES

| | Results of Wet Chemical Analysis (Wt %)‡ | | | | | Hardness Rockwell | Average Calculated Grain Size | Coercive Force, $H_c$ | Magnetic Saturation |
|---|---|---|---|---|---|---|---|---|---|
| | Co | Ta | Ti | Fe | Ni | A | Microns | Oersteds¶ | Percent§ |
| PRESENT INVENTION | | | | | | | | | |
| First Region | 5.45 | 0.26 | 0.16 | 0.06 | 0.02 | 87.6 | 7.8 | 76 | 92 |
| | 5.48 | 0.26 | 0.16 | 0.07 | 0.02 | | | | |
| Second Region | 10.75 | 0.285 | 0.17 | 0.13 | 0.02 | 88.4 | 2.8 | 111 | 91 |
| | 10.78 | 0.285 | 0.17 | 0.13 | 0.02 | | | | |
| CONTROL SAMPLES | | | | | | | | | |
| Sintered FPB* | 10.08 | 0.28 | 0.40 | 0.10 | 0.04 | 86.1 | 6.7 | 51 | 100 |
| | | | | | | | | 50 | 100 |
| Sintered SPB** | 9.00 | 0.278 | 0.15 | 0.10 | 0.02 | 89.1 | 2.8 | 124 | 91 |
| | 9.01 | 0.275 | 0.16 | 0.11 | 0.02 | | | 125 | 92 |

*FPB = First Powder Blend
**SPB = Second Powder Blend
‡Nb, Cr, & V, when analyzed, were usually less than about 0.01 wt %. Balance of the material is W + C + other minor impurities.
§100 percent = about 160 emu per gram or 1.7 tesla or 17,000 gauss
¶1 oersted = 79.58 ampere-turns per meter (A/m) = 0.08 kiloampere-turns per meter (kA/m)

also suggests a stepwise gradation of cobalt content from the first region (average about 12.3 wt %) to the second region (average about 7.6 wt %) of the article.

Figure 6:
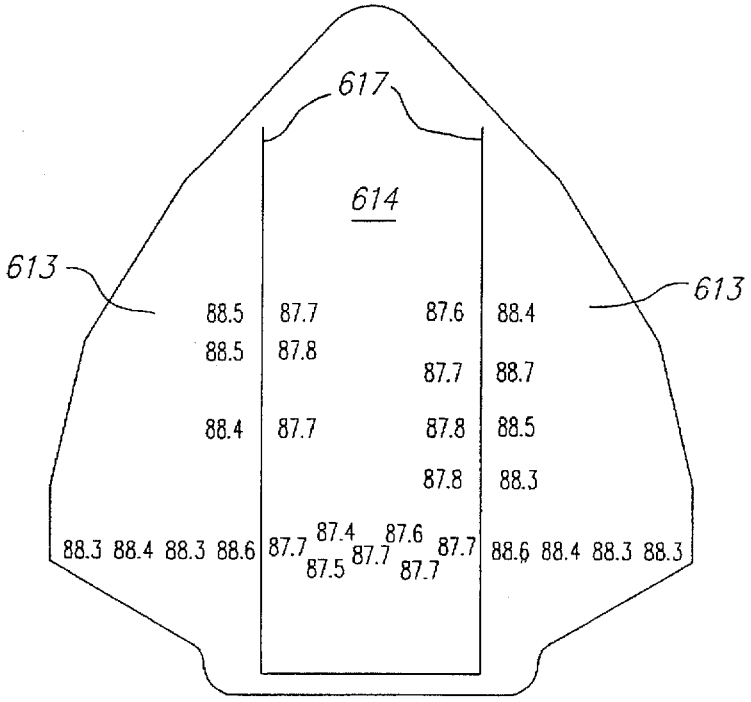
FIG. 6 corresponds to the results of hardness measurements at various locations (i.e., hardness distribution profile) as a longitudinal cross section of an article made according to the methods of Example 1.

FIG. 6 presents the results of a hardness profile on an article which indicate that the hardness of the first region (inner or core portion of this article, Rockwell A≅87.4–87.8) is lower than the hardness of the second region (outer or peripheral portion of the present article, Rockwell A≅88.3–88.7).

METHOD OF USE

Figure 7:
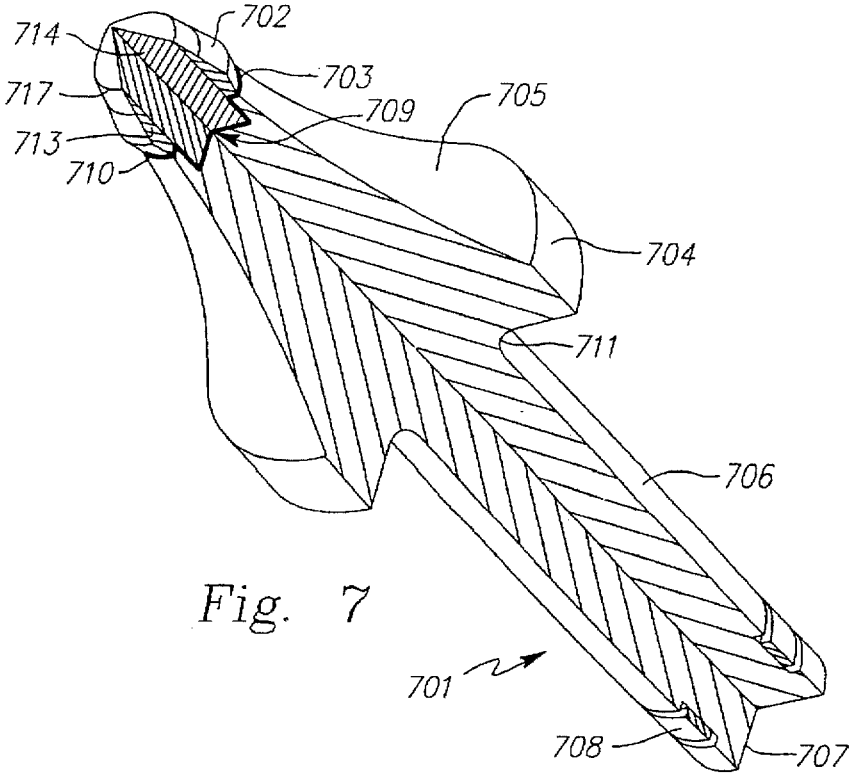
FIG. 7 corresponds to a schematic cut away view of a conical cutter bit 701 incorporating an article made by the methods of Example 1.

A sufficient number of sintered articles made according to the present Example were brazed to steel bodies to form "KENNAMETAL®" KB175SLSA Conical Tools as schematically depicted in FIG. 7 (Kennametal Inc., Latrobe, Pa.) used in conjunction with "KENNAMETAL®" KB175SLSA Cutting System. The brazing of the articles was accomplished using the materials disclosed in commonly owned U.S. Pat. No. 5,324,098, issued in the name of Massa et al, on Jun. 28, 1994, and entitled "Cutting Tool Having Tip with Lobes." The subject matter of U.S. Pat. No. 5,324,098 is incorporated by reference. Conical tool 701 is comprised of an elongated body 705 with an attached hard cutting tip 702. The elongated body 705 has an axially forward end 710 and an axially rearward end 707. Between ends 710 and 707 are a radially projecting flange 704, an enlarged diameter portion 711, and a reduced diameter section 706. The axially forward end 710 comprise a socket 709 for receiving hard cutting tip 702. Hard cutting tip 705 is comprised of a first region 714 and a second region 715 at least partially autogeneously metallurgically bonded of interface 717. Hard tip 702 is in contacting communication with elongated body 705 by an attachment means 703. The attachment means 703 may include braising, shrink fitting, interference fitting and combination thereof. Conical tool 701 may further comprise a retaining means depicted in FIG. 7 as a retainer sleeve or clip 708.

The cutting system was used with a Joy 12HN9 Continuous Miner (Joy Manufacturing Co., Ltd., Johannesburg, South Africa) to mine coal. Particularly, coal having a compressive strength or hardness of about 12 megapascal (MPa) (3.5 kilo pounds per square inch (ksi)) was mined about 3 meters (9.8 feet) high for a given distance using prior art tools made from a coarse grained tungsten carbide-cobalt alloy (see sample 10 in Table V) and the tools incorporating the articles made according to the present Example. After 4 meters (13.1 feet), 8 meters (26.2 feet) and 12 meters (39.4 feet) of mining, the length change of the tools incorporating the prior art and the tools incorporating articles made according to the present Example were determined. The included angle of the tip of some tools was also measured. The results determined after 4 meters (13.1 feet), 8 meters (26.2 feet) and 12 meters (39.4 feet) for various positions are summarized in Tables II, III and IV, respectively. Specifically, Tables II, III and IV show the position of the tool, the change in length for the tool incorporating the prior art and the tool incorporating articles of the present Example, the ratio of the change in length, the magnitude of the included tip angle for the prior art tool, the magnitude of the included angle for the present invention and the ratio of the change in tip included angle for the prior art tool to the change in tip included angle for the present invention. It should be noted that the included tip angle for all of the tools started at about 75°.

Figure 8B:
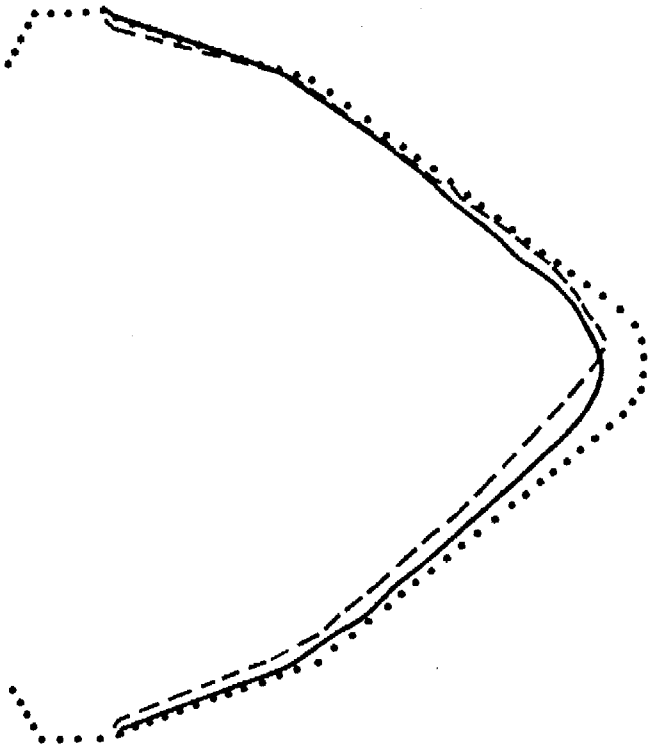
FIGS. 8A, 8B, and 8C correspond to tool profile comparisons of articles made according to the methods of Example 1 of the present invention (————) and the prior art (- - - - - -) after use to mine 4 meters (13.1 feet) of coal as described in Example 1 and compared to the starting tool profile (· · · · · · · ·).
Figure 8A:
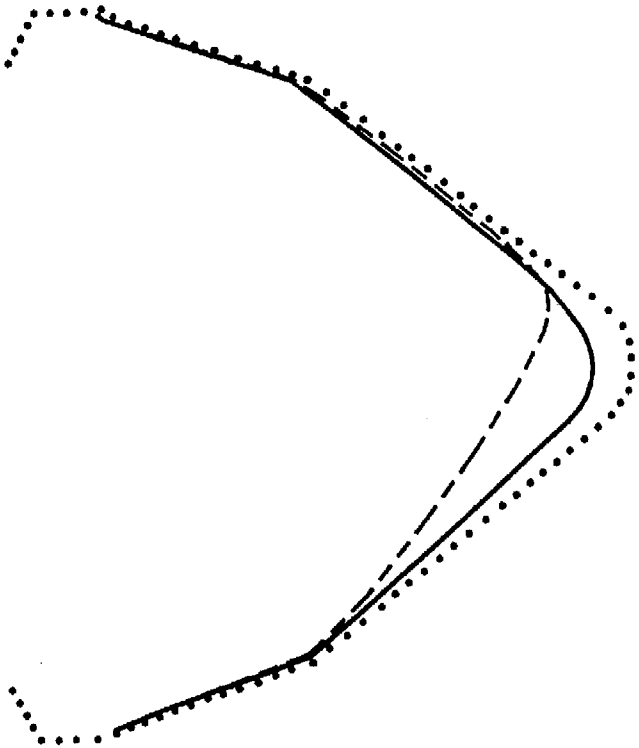
Figure 9A:
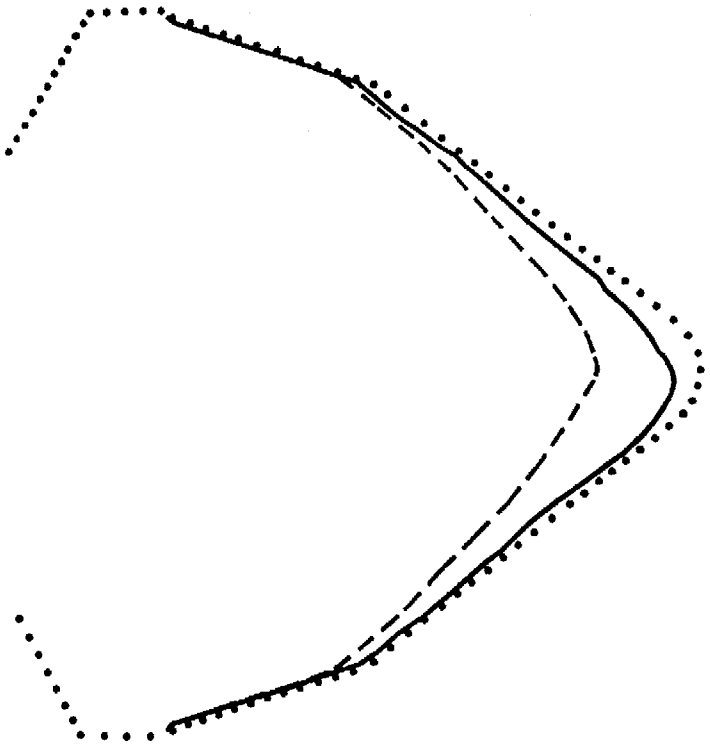
FIG. 9A, 9B, and 9C correspond to profile comparisons of the articles of the present invention (————) and the prior art (- - - - - -) after use to mine 8 meters (26.2 feet) of coal as described in Example 1 and compared to the starting tool profile (••••••••)
Figure 8C:
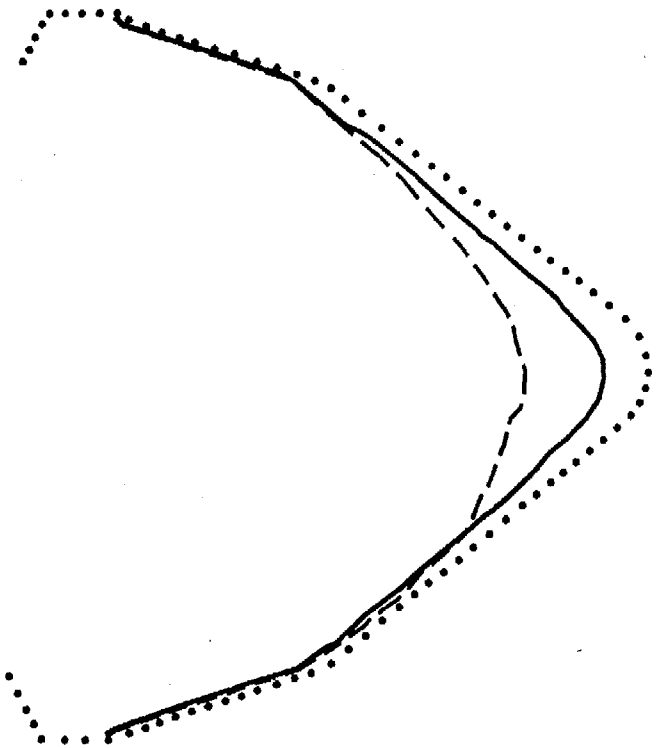
Figure 9C:
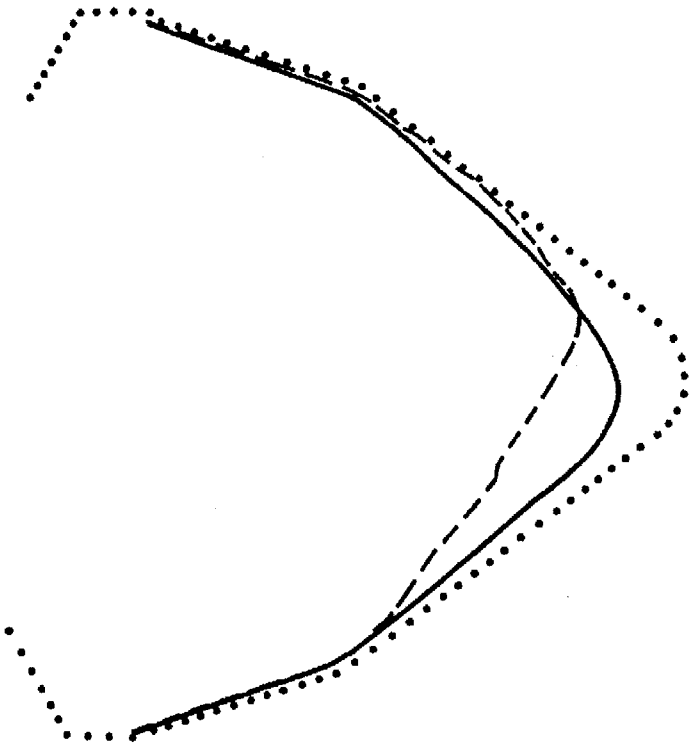
Figure 9B:
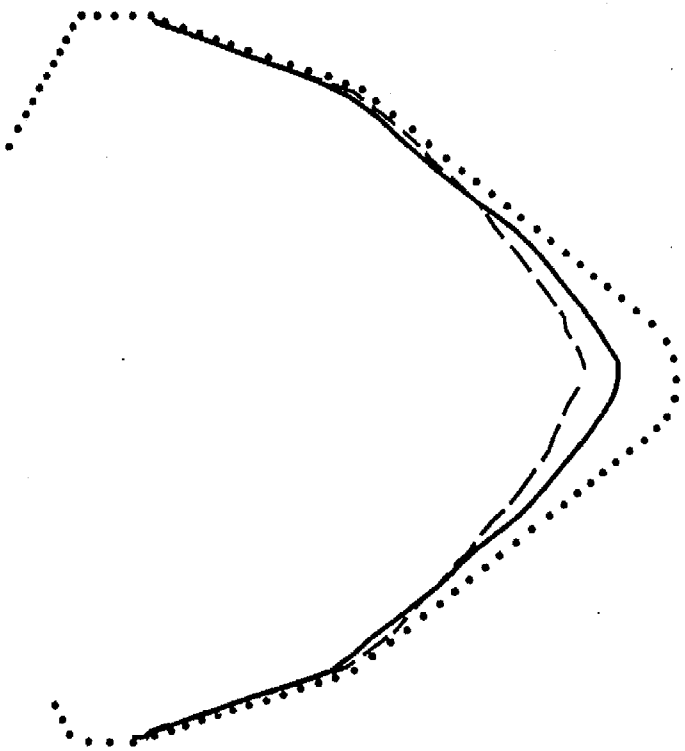

To graphically demonstrate various aspects of the present invention, FIGS. 8 and 9 present a comparison of profile measurements of the tips of the present invention (——), tips of the prior art ( - - - - - ) and the starting tip profile (· · · · · · · · ·) as a function of position in the cutting system for positions 1, 3 and 5 after 4 meters (13.1 feet) of mining and positions 1, 5 and 6 after 8 meters (26.2 feet) of mining. The data for Tables II, III and IV and the comparisons shown in FIGS. 8 and 9 demonstrate, among other things, that articles made according to the present invention exhibit superior wear properties while substantially maintaining their original profiles. Thus, the present Example demonstrates, among other things, the method for making articles exhibiting superior properties for applications involving the removal of materials.

TABLE II

TOOL CHARACTERIZATION AFTER MINING FOR FOUR METERS

| | Length Change (Inches) | | | Included Angle (Degrees) | | |
|---|---|---|---|---|---|---|
| Position‡ | Prior Art | Present Invention | Ratio | Prior Art | Present Invention | Ratio* |
| 1 | 0.075 | 0.033 | 2.3:1 | 89 | 80 | 2.8:1 |
| 2 | 0.028 | 0.032 | 0.9:1 | 80 | 80 | 1.0:1 |
| 3 | 0.039 | 0.039 | 1.0:1 | 81 | 80 | 1.2:1 |
| 4 | 0.076 | 0.050 | 1.5:1 | 91 | 83 | 2.0:1 |
| 5 | 0.107 | 0.035 | 3.1:1 | 96 | 80 | 4.2:1 |
| 6 | 0.061 | 0.044 | 1.4:1 | 88 | 80 | 2.6:1 |
| Average | 0.064 | 0.039 | 1.6:1 | 88 | 81 | 2.2:1 |

TABLE III

TOOL CHARACTERIZATION AFTER MINING FOR EIGHT METERS

| | Length Change (Inches) | | | Included Angle (Degrees) | | |
|---|---|---|---|---|---|---|
| Position‡ | Prior Art | Present Invention | Ratio | Prior Art | Present Invention | Ratio* |
| 1 | 0.090 | 0.022 | 4.0:1 | 92 | 80 | 3.4:1 |
| 2 | 0.069 | 0.087 | 0.8:1 | 90 | 87 | 1.3:1 |
| 5 | 0.084 | 0.053 | 1.6:1 | 94 | 83 | 2.4:1 |
| 6 | 0.093 | 0.059 | 1.6:1 | 96 | 85 | 2.1:1 |
| Average | 0.084 | 0.055 | 1.5:1 | 93 | 84 | 2.0:1 |

TABLE IV

TOOL CHARACTERIZATION AFTER MINING FOR TWELVE METERS

| | Length Change (Inches) | | | Included Angle (Degrees) | | |
|---|---|---|---|---|---|---|
| Position‡ | Prior Art | Present Invention | Ratio | Prior Art | Present Invention | Ratio* |
| 2 | 0.121 | 0.043 | 2.8:1 | 97 | 81 | 3.7:1 |
| 3 | 0.038 | 0.066 | 0.6:1 | 83 | 78 | 2.7:1 |
| 4 | 0.076 | 0.098 | 0.8:1 | 86 | 82 | 1.6:1 |
| 6 | 0.093 | 0.118 | 0.8:1 | 91 | 93 | 0.9:1 |
| Average | 0.082 | 0.081 | 1.0:1 | 89 | 84 | 1.6:1 |

*Change in tip included angle of the present invention: change in tip included angle of the prior art ‡Data for positions 3 & 4 in Table III and 1 & 5 in Table IV could not be reported because either the tools of the present invention or the prior art failed by, for example, brazing failure or other tool breakage.

EXAMPLE II

The present Example demonstrates, among other things, that a range of amounts of a first powder blend may be combined with an at least one additional powder blend to form articles of the present invention. In particular, the methods of Example 1 were substantially repeated to form sintered articles having about 17.5 mm (0.689 inch) diameter, except that a total mass of the green body measured about 47 grams rather than 27 grams and the green body diameter measured about 21 mm (0.827 inch). In addition, the consolidation load used to form the green bodies of this Example was about 37,365 N (8400 lbs) rather than 31,138 N(7000 lbs).

As in Example 1, control samples comprised only of the first powder blend or only of the second powder blend were made for comparison. The resultant articles of the present Examples were characterized in a manner similar to those of Example 1. Table V summarizes the weight percent of the first powder blend and the second powder blend which were combined to form the green bodies and eventually the densified articles, the dimension of the first powder blend zone, the results of wet chemical analysis, the results of hardness measurements, the results of magnetic properties measurements. Thus, the present Examples, among other things, teaches a method for tailoring the binder content of a first region and a second region for an article made by the methods of the present invention.

TABLE V

| Sample No. | FPB* Zone Dimensions Length mm(inch) | Diameter mm(inch) | Charging Portions Wt % FPB* | Wt % SPB** | Location Within Sample | Results of Wet Chemical Analysis (Wt %)‡ Co | Ta | Ti | Nb | Fe | Cr | Average Calculated Grain Size Microns | Hardness Rockwell A | Coercive Force, $H_c$ Oersteds¶ | Magnetic Saturation Percent§ |
|---|---|---|---|---|---|---|---|---|---|---|---|---|---|---|---|
| 88 | 15.5(0.61) | 8.1(0.32) | | 78.7 | Second | 9.89 | 0.27 | 0.18 | 0.05 | 0.14 | 0.01 | 2.91 | 88.6 | 115 | 91 |
| | | | | | Region | 9.89 | 0.28 | 0.18 | 0.04 | 0.15 | 0.01 | | | | |
| | | | 21.3 | | First | 5.79 | 0.23 | 0.15 | 0.04 | 0.13 | 0.02 | 7.10 | 87.8 | 79 | 94 |
| | | | | | Region | 5.74 | 0.23 | 0.15 | 0.04 | 0.13 | 0.01 | | | | |
| 74 | 17.3(0.68) | 8.6(0.34) | | 73.2 | Second | 10.14 | 0.28 | 0.17 | 0.05 | 0.15 | 0.01 | 2.92 | 88.4 | 112 | 91 |
| | | | | | Region | 10.09 | 0.28 | 0.17 | 0.04 | 0.16 | 0.01 | | | | |
| | | | 26.8 | | First | 5.99 | 0.23 | 0.15 | 0.04 | 0.12 | <0.01 | 7.07 | 87.7 | 76 | 92 |
| | | | | | Region | 5.98 | 0.22 | 0.15 | 0.04 | 0.15 | 0.01 | | | | |
| 91 | 19.6(0.77) | 8.6(0.34) | | 68.9 | Second | 10.52 | 0.29 | 0.19 | 0.06 | 0.15 | | — | — | — | — |
| | | | | | Region | 10.49 | 0.30 | 0.18 | 0.05 | 0.15 | <0.01 | | | | |
| | | | 31.1 | | First | 6.00 | 0.23 | 0.15 | 0.04 | 0.13 | 0.02 | — | — | — | — |
| | | | | | Region | 6.05 | 0.23 | 0.15 | 0.04 | 0.15 | 0.02 | | | | |
| 92 | 19.6(0.77) | 8.6(0.34) | | 68.9 | Second | 10.41 | 0.28 | 0.17 | 0.04 | 0.15 | | 2.90 | 88.4 | 111 | 91 |
| | | | | | Region | 10.41 | 0.27 | 0.17 | 0.04 | 0.15 | <0.01 | | | | |
| | | | 31.1 | | First | 6.17 | 0.24 | 0.15 | 0.04 | 0.13 | 0.01 | 6.86 | 87.6 | 76 | 92 |
| | | | | | Region | 6.17 | 0.24 | 0.15 | 0.04 | 0.14 | 0.02 | | | | |
| 82 | 19.3(0.76) | 9.4(0.37) | | 64.0 | Second | 10.74 | 0.29 | 0.18 | 0.05 | 0.17 | 0.01 | 2.90 | 88.3 | 109 | 91 |
| | | | | | Region | 10.77 | 0.29 | 0.19 | 0.06 | 0.18 | 0.02 | | | | |
| | | | 36.0 | | First | 6.33 | 0.23 | 0.15 | 0.04 | 0.12 | | 6.93 | 87.6 | 74 | 94 |
| | | | | | Region | 6.34 | 0.23 | 0.15 | 0.04 | 0.12 | <0.01 | | | | |
| 10 | N/A | N/A | 100 | 0 | N/A | 9.55 | 0.25 | 0.16 | 0.04 | 0.17 | | 6.21 | 86.1 | 57 | 99 |
| | | | | | | 9.56 | 0.24 | 0.16 | 0.05 | 0.17 | <0.01 | | | | |
| 22 | N/A | N/A | 0 | 100 | N/A | 9.05 | 0.27 | 0.17 | 0.04 | 0.13 | | 2.82 | 89.1 | 125 | 89 |
| | | | | | | 9.06 | 0.28 | 0.17 | 0.04 | 0.13 | <0.01 | | | | |

*FPB = First Powder Blend
**SPB = Second Powder Blend
‡Each sample contained less than about 0.01 wt % of each of Ni, Hf, and V. The balance of each sample comprised W + C + other minor impurities.
§100 percent = about 160 emu per gram or 1.7 tesla or 17,000 gauss
¶1 oersted = 79.58 ampere-turns per meter (A/m) = 0.08 kiloampere-turns per meter (kA/m)

What is claimed is:

1. A tip for use in excavation comprising:

a forward portion having a surface extending radially outwardly while extending rearwardly along a longitudinal axis x-x,;

a rearward portion for attachment to a tool body;

said rearward portion joined to and located behind said forward portion along said longitudinal axis x-x;

a first forwardmost portion, the first forwardmost portion comprising a leading surface of said forward portion and a first cermet composition comprising a first ceramic component having a first grain size comprising about 0.5 μm to about 12 μm and a first binder at a first content comprising about 5 wt. % to about 10 wt. %; and a second forwardmost portion, the second forwardmost portion, adjacent to the first forwardmost portion, comprising an outer surface of said forward portion and a second cermet composition comprising a second ceramic component having a second grain size comprising about 0.5 μm to about 8 μm and a second binder at a second content comprising about 8 wt. % to about 15 wt. %;

wherein said first binder content is less than said second binder content, and said first grain size is greater than said second grain size;

wherein said first cermet composition is located radially inside of and is autogeneously metallurgically bonded to said second cermet composition;

wherein there is a stepwise gradation of said first binder content and said second binder content at said autogeneous metallurgical bond; and wherein during use in said excavation the first cermet composition is more wear resistant than said second cermet composition.

2. The tip according to claim 1, wherein the first forwardmost portion extends forwardly beyond the second forwardmost portion.

3. The tip according to claim 1, wherein said first cermet composition has a first hardness and said second cermet composition has a second hardness wherein said second hardness is greater than said first hardness.

4. The tip according to claim 2, wherein said first cermet composition has a first hardness and said second cermet composition has a second hardness wherein said second hardness is greater than said first hardness.

5. The tip according to claim 1, wherein said first cermet composition consists essentially of tungsten carbide and said first binder is selected from the group consisting of cobalt and cobalt alloys, and wherein said second cemented carbide composition consists essentially of tungsten carbide and said second binder is selected from the group consisting of cobalt and cobalt alloys.

6. The tip according to claim 1, wherein both said first and said second cermet compositions contain zero volume percent eta phase.

7. The tip according to claim 5, wherein said first cermet composition comprises about 5.5 wt. % to about 8 wt. % cobalt and said second cermet composition comprises about 8 wt. % to about 15 wt. % cobalt.

8. The size according to claim 5 wherein said first ceramic component grain size comprises about 3 μm to about 10 μm and said second ceramic component grain size comprises about 1 μm to about 5 μm.

9. The tip according to claim 1 wherein said first ceramic component grain size comprises about 5 μm to about 8 μm and said second ceramic component grain size comprises about 2 μm to about 5 μm.

10. The tip according to claim 5 wherein said first ceramic component grain size comprises about 5 μm to about 8 μm and said second ceramic component grain size comprises about 2 μm to about 5 μm.

11. A tip for use in excavation comprising:

a forward portion having a surface extending radially outwardly while extending rearwardly along a longitudinal axis x-x;

a rearward portion for attachment to a tool body;

said rearward portion joined to and located behind said forward portion along said longitudinal axis x-x;

a first forwardmost portion, the first forwardmost portion comprising a leading surface of said forward portion and a first cermet composition; and a second forwardmost portion, the second forwardmost portion, adjacent to the first forwardmost portion, comprising an outer surface of said forward portion and a second cermet composition;

wherein said first cermet composition comprises a first tungsten carbide comprising a first grain size comprising about 5 μm to about 8 μm and a first cobalt or cobalt alloy comprising a first binder content comprising about 5.5 wt. % to about 8 wt %;

wherein said second cermet composition comprises a second tungsten carbide comprising a second grain size comprising about 2 μm to about 5 μm and a second cobalt or cobalt alloy comprising a second binder content comprising about 8 wt. % to about 15 wt. %;

wherein said first binder content is less than said second binder content, and said first tungsten carbide grain size is greater than said second tungsten grain size;

wherein said first cermet composition is located radially inside of and is autogeneously metallurgically bonded to said second cermet composition;

wherein there is a stepwise gradation of said first binder content and said second binder content at said autogeneous metallurgical bond; and wherein during use in said excavation the first cemented carbide composition is more wear resistant than said second cemented carbide composition.

12. The tip according to claim 11, wherein the first forwardmost portion extends forwardly beyond the second forwardmost portion.

13. The tip according to claim 11, wherein said first cermet composition has a first hardness and said cermet composition has a second hardness wherein said second hardness is greater than said first hardness.

14. The tip according to claim 13, wherein said first hardness comprises at least about 87 Rockwell A.

15. The tip according to claim 13, wherein said second hardness comprises at least about 88 Rockwell A.

16. The tip according to claim 11, wherein both said first and said second cermet compositions contain zero volume percent eta phase.

17. The tip according to claim 11, wherein the first cermet composition comprises about 6 wt. % cobalt or cobalt alloy.

18. The tip according to claim 11, wherein said second cermet composition comprises about 6 wt. % cobalt or cobalt alloys.

19. The tip according to claim 11, wherein said first tungsten carbide grain size comprises about 7 μm.

20. The tip according to claim 19, wherein said second tungsten carbide grain size comprises about 3 μm.

21. The tip according to claim 11, wherein the combination of the first cermet composition being more wear resistant than the second cermet composition imparts self-sharpening characteristics to the tip.

22. The tip according to claim 11, wherein the combination of the first cermet composition being more wear resistant than the second cermet composition imparts the retention of cutting ability to the tip during excavation.

23. The tip according to claim 11, wherein the tip is used for mining.

24. The tip according to claim 11, wherein the tip is used for construction.

25. The tip according to claim 23, wherein the mining comprises coal mining.

26. The tip according to claim 11, wherein a ratio of the grain size of the tungsten carbide of the first cemented carbide composition to the grain size of the tungsten carbide of the second cemented carbide composition comprises about 1.5 to about 12.

27. The tip according to claim 11, wherein a ratio of the grain size of the tungsten carbide of the first cermet composition to the grain size of the tungsten carbide of the second cermet composition comprises about 1.5 to 3.

28. The tip according to claim 11, wherein a mean free path of the second binder comprises about 0.5 to about 1.5 micrometers.

29. The tip according to claim 11, wherein a ratio of the volume of the first cermet composition to the volume of second cermet composition comprises about 0.25 to about 4.

30. The tip according to claim 11, wherein a ratio of the volume of the first cermet composition to the volume of the second cermet composition comprises about 0.33 to 2.

31. The tip according to claim 11, wherein a ratio of the volume of the first cermet composition to the volume of the second cermet composition comprises about 0.4 to about 2.

32. The tip according to claim 11, wherein a hardness of the first cermet composition is less than a hardness of the second cermet composition.

33. The tip according to claim 32, wherein a hardness of the second cermet composition comprises at least about 88 Rockwell A.

34. The tip according to claim 11, wherein the autogeneously metallurgically formed bond coincides with a stepwise gradation of the said grain size from the first cermet composition to said grain size of the second cermet composition.

35. The tip according to claim 11, wherein said first and second tungsten carbide comprise macrocrystalline tungsten carbide.

36. The tip according to claim 11, wherein a percent magnetic saturation of the first cermet composition comprises at least about 92.

37. The tip according to claim 36, wherein the percent magnetic saturation of the first cermet composition comprises up to about 94.

38. The tip according to claim 36, wherein a percent magnetic saturation of the second cermet composition comprises at most about 91.

39. The tip according to claim 11, wherein a coercive force ($H_c$) of the first cermet composition comprises at least about 74 oersted.

40. The tip according to claim 11, wherein a coercive force ($H_c$) of the first cermet composition comprises up to about 79 oersted.

41. The tip according to claim 11, wherein a coercive force of the second cermet composition comprises at least about 109 oersted.

42. The tip according to claim 33, wherein a coercive force ($H_c$) of the second cermet comprises up to 115 oersted.

* * * * *